US006527685B2

(12) United States Patent
Endelman et al.

(10) Patent No.: US 6,527,685 B2
(45) Date of Patent: Mar. 4, 2003

(54) REFORMER EXERCISE APPARATUS

(75) Inventors: Ken Endelman, Sacramento, CA (US); Brian Janowski, Marquette, MI (US)

(73) Assignee: Balanced Body, Inc., Sacramento, CA (US)

( * ) Notice: Subject to any disclaimer, the term of this patent is extended or adjusted under 35 U.S.C. 154(b) by 0 days.

(21) Appl. No.: 09/835,204

(22) Filed: Apr. 12, 2001

(65) Prior Publication Data

US 2001/0056011 A1 Dec. 27, 2001

Related U.S. Application Data

(63) Continuation-in-part of application No. 09/521,555, filed on Mar. 9, 2000, which is a continuation-in-part of application No. 09/275,755, filed on Mar. 25, 1999, now Pat. No. 6,186,929, which is a continuation-in-part of application No. 09/266,286, filed on Mar. 11, 1999, now abandoned.

(51) Int. Cl.[7] ..... A63B 21/02

(52) U.S. Cl. ..... 482/121; 482/135; 482/72

(58) Field of Search ..... 482/71–72, 101, 482/121–123, 95–96, 54, 129–130, 132–136, 142

(56) References Cited

U.S. PATENT DOCUMENTS 339,638 A 4/1886 Goldie
1,621,477 A 3/1927 Pilates
1,738,987 A 12/1929 Dattilo
1,750,549 A 3/1930 Thomson et al.
1,979,783 A 11/1934 Williams et al.
1,980,036 A 11/1934 Casler et al.
2,733,922 A 2/1956 Diego
3,261,606 A 7/1966 Elia et al.
3,586,322 A 6/1971 Kverneland
3,770,267 A * 11/1973 McCarthy ..... 272/58
3,892,404 A 7/1975 Martucci (List continued on next page.)

FOREIGN PATENT DOCUMENTS

FR 1470421 1/1967
FR 2625907 7/1989

*Primary Examiner*—Jerome W. Donnelly
*Assistant Examiner*—Lori Baker Amerson
(74) *Attorney, Agent, or Firm*—John R. Wahl; Merchant & Gould P.C.

(57) ABSTRACT

A reformer exercise apparatus comprises a telescopic rectangular frame, a movable carriage mounted on the frame for supporting a user, and an elongated elastic member extending between the frame and the movable carriage for biasing the carriage toward the one end of the frame. The telescopic rectangular frame has a first frame section and a second frame section that each includes two spaced apart parallel tubular rail members. One set of rail members is telescopically received in the other set of rail members so that the frame is selectively movable between a first storage position and an extended operating position.

18 Claims, 26 Drawing Sheets

U.S. PATENT DOCUMENTS

| | | | | | |
|---|---|---|---|---|---|
| 4,084,815 | A | | 4/1978 | Flannery | |
| 4,113,250 | A | * | 9/1978 | Davis | 272/93 |
| 4,272,074 | A | | 6/1981 | Sferele | |
| 4,290,600 | A | | 9/1981 | Kolbel | 272/137 |
| 4,357,010 | A | | 11/1982 | Telle | 272/117 |
| 4,376,533 | A | | 3/1983 | Kolbel | 272/137 |
| 4,383,684 | A | | 5/1983 | Schliep | |
| 4,517,966 | A | | 5/1985 | von Othegraven | 128/75 |
| 4,700,945 | A | | 10/1987 | Rader | |
| 4,706,953 | A | | 11/1987 | Graham | |
| 4,709,918 | A | * | 12/1987 | Grinblat | 272/97 |
| 4,768,776 | A | | 9/1988 | Giannotti | |
| 4,776,583 | A | | 10/1988 | Jennings | 272/73 |
| 4,884,802 | A | | 12/1989 | Graham | |
| 4,911,438 | A | | 3/1990 | Van Straaten | |
| 4,974,832 | A | | 12/1990 | Dalebout | |
| 5,014,966 | A | | 5/1991 | Wang | 267/64 |
| 5,024,214 | A | | 6/1991 | Hayes | |
| 5,066,005 | A | | 11/1991 | Luecke | |
| 5,207,628 | A | * | 5/1993 | Graham | 482/140 |
| 5,263,913 | A | | 11/1993 | Boren | |
| 5,338,278 | A | | 8/1994 | Endelman | |
| 5,352,169 | A | | 10/1994 | Eschenbach | 482/57 |
| 5,364,327 | A | | 11/1994 | Graham | |
| D354,780 | S | | 1/1995 | Endelman | |
| D354,781 | S | | 1/1995 | Endelman | |
| 5,423,729 | A | | 6/1995 | Eschenbach | 482/70 |
| D362,700 | S | | 9/1995 | Breibart et al. | |
| 5,529,554 | A | * | 6/1996 | Eschenbach | 482/57 |
| 5,580,340 | A | | 12/1996 | Yu | 482/96 |
| 5,607,381 | A | | 3/1997 | Endelman | |
| 5,653,670 | A | | 8/1997 | Endelman | |
| 5,681,249 | A | | 10/1997 | Endelman | |
| 5,792,033 | A | * | 8/1998 | Merrithew | 482/96 |
| 5,795,271 | A | | 8/1998 | Pearson | 482/72 |
| 5,807,217 | A | | 9/1998 | Endelman | |
| 5,816,981 | A | | 10/1998 | Hung | 482/54 |
| 5,853,357 | A | | 12/1998 | Jones, Jr. | 482/140 |
| 6,179,759 | B1 | | 1/2001 | Tellone | 482/111 |
| 6,186,929 | B1 | | 2/2001 | Endelman et al. | 482/121 |
| 6,206,530 | B1 | | 3/2001 | Eberts | 359/879 |
| 2001/0001304 | A1 | | 5/2001 | Maresh et al. | 482/66 |
| 2001/0001776 | A1 | | 5/2001 | Jones | 482/97 |
| 2001/0004623 | A1 | | 6/2001 | Miller | 482/52 |

* cited by examiner

REFORMER EXERCISE APPARATUS

CROSS REFERENCE TO RELATED APPLICATIONS

This application is a continuation in part of U.S. patent application Ser. No. 09/521,555, filed on Mar. 9, 2000, which is a continuation-in-part of U.S. patent application Ser. No. 09/275,755, filed Mar. 25, 1999, now U.S. Pat. No. 6,186,929, which is also a continuation-in-part of U.S. patent application Ser. No. 09/266,286, filed Mar. 11, 1999, now abandoned, all three of which are hereby incorporated by reference in their entirety.

BACKGROUND OF THE INVENTION

1. Field of the Invention

This invention relates generally to the field of exercise equipment in which a movable carriage is utilized to at least partially support a user's body, commonly referred to as a "reformer", and more particularly to a compact lightweight reformer.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. U.S. Pat. No. 5,066,005 and my patents referred to above are representative of the current state of evolutionary development of these changes that have taken place since 1927.

The current conventional "reformer" type apparatus includes a wheeled platform carriage, which rides on a rectangular wooden or metal frame. The above referenced patent discloses examples of wood framed reformers. An example of a metal frame reformer is disclosed in U.S. Pat. No. 5,792,033 to Merrithew. The carriage, which rides on the frame, is connected to a series of parallel springs or elastic members, which are in turn connected to a foot end of the rectangular frame. The carriage typically rides on parallel rails or tracks typically mounted to the inside of the longer sides of the rectangular frame. This carriage has a flat, padded upper surface and typically includes a pair of spaced, padded, upright shoulder stops and a headrest at one end to support the shoulders and head of the user when he/she is reclined on the carriage. An adjustable foot bar, foot support, or footrest against which the user places his/her feet is mounted to the foot end of the rectangular frame. A spring support rod is positioned across the foot end between the tracks by a spring support bracket fastened to the frame. The rod typically fits in one of three or four recesses or slots in the support bracket, depending on the size or ability of the user. Alternatively, the spring support rod may be permanently fastened to the frame. The user can then push against the footrest to move the carriage along the track away from the footrest against spring tension to exercise the leg and foot muscle groups in accordance with prescribed movement routines. The carriage is prevented from moving close to the footrest by a stop pin typically fastened to the top of each track, against which the carriage abuts when the carriage is at rest. The maximum limit of carriage travel is provided by the headrest abutting the head end wall of the frame.

U.S. Pat. Nos. 5,338,276, 5,607,381 and 5,681,249 disclose reformers and several footrest arrangements and adjustable headrest assemblies for this type of exercise apparatus. One of the difficulties, which the currently available reformers do not optimally address, is the portablilty and storability of the apparatus. Accordingly there is a need for a reformer type of exercise apparatus that can be efficiently stored and transported without sacrificing such features as having an adjustable carriage and spring arrangement to accommodate extremes in physical body sizes as well as optimally position the carriage with respect to the footrests for user's within the normal body size range. Another problem with the conventional design of reformers is that the reformer is relatively bulky, heavy, and takes up a substantial amount of floor area even when not in use. Most reformers have a footprint of about two feet by seven or eight feet. Therefore, in a class or studio setting a substantial amount of floor space must be allocated totally to the reformers. There is therefore a need for a reformer that can be compactly moved and stored when not in use.

Often a user may wish to take the reformer to different locations. Unfortunately for this purpose, most reformers currently available are heavy and are not designed to be easily transported. There is therefore also a need for a full performance reformer that has a frame design that can be easily dismantled and transported by one person and easily assembled for use.

In some situations the movable carriage on conventional reformers may tend to tilt upward from the rails upon which the carriage rides, as when a user improperly stands with one foot on the edge of the carriage and one foot on the frame. Accordingly there is also a need for a reformer apparatus that inherently securely retains the carriage on the tracks or rails while simultaneously permitting guided free movement of the carriage along the rails against spring tension.

SUMMARY OF THE INVENTION

The reformer exercise apparatus in accordance with the present invention addresses the above-identified limitations in conventional reformer designs. The present invention is an exercise apparatus, which comprises a wheeled carriage having a generally flat top surface. The carriage is movably mounted on parallel track members of a generally rectangular frame, which has a head end and a foot end. The carriage has a pair of upwardly extending shoulder stops mounted thereto at one end and a headrest between the shoulder stops that extends outward from the carriage toward the head end of the frame. A plurality of elastic members may be selectively connected between the foot end of the frame and the carriage to elastically bias the carriage toward the foot end of the frame.

The frame primarily comprises a pair of metal extrusion rail members spaced in parallel relation by a foot end support member and a head end support member. A pair of upright arm extensions are secured to the head end support member at the head end of each of the rails. A spring support bracket integral with the foot end support member is used to fasten one end of each of a plurality of springs.

The head end of the frame supports a pair of upright pulley support arms to which are fastened rope pulleys to permit the carriage to travel against spring tension the full length of the parallel tracks by the user pulling ropes fastened to the carriage and running through the pulleys.

The rail members of the frame are comprised of a single metal extrusion having a closed mid portion, an inner guide/support channel portion, and an outer T-slot portion.

The frame may be formed in two removable sections, a head section and a foot section, to create a highly transportable and compact exercise apparatus. The two sections are joined by bayonet type tongues, which fit within the mid portions of the extrusion of the other section of the rail members.

The carriage assembly is captured between the rail members by a roller wheel and guide roller assembly in which four roller wheels ride in a guide/support channel in the extrusion rail members to hold the carriage onto the rails. The guide rollers ride in the same channel as the support roller wheels but engage the vertical wall of the support channel to prevent binding of the carriage on the rail members and minimize friction between the carriage and the rails.

The foot bar assembly is a generally U shaped bar member which is supported by a support bracket assembly which slides in the T-slot of the rail members and includes both horizontal and vertical foot bar positions along with various angular positions permitting the foot bar to be selectively positioned in a plurality of vertical positions from the carriage and the foot end of the frame.

In another embodiment of the reformer in accordance with the invention, the two frame sections may be telescopically joined, to create a collapsible telescopic frame that is also highly transportable and compact. Generally, in this embodiment, a pair of rail members of a first frame section are tubularly constructed, each having an open end. A pair of second frame section rail members are then telescopically received in the open ends of the first frame section rail members. The frame is selectively movable between a storage position in which the second frame section rail members are fully telescoped within the first frame section rail members and an extended operating position in which the second frame section rail members are fully extended from and retained by the first frame section rail members. In this alternative embodiment, the carriage assembly is captured between the rail members by two sets of wheel assemblies as in the first embodiment at the foot end of the rail members and two sets of wheel assemblies that ride on the head end rail sections.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
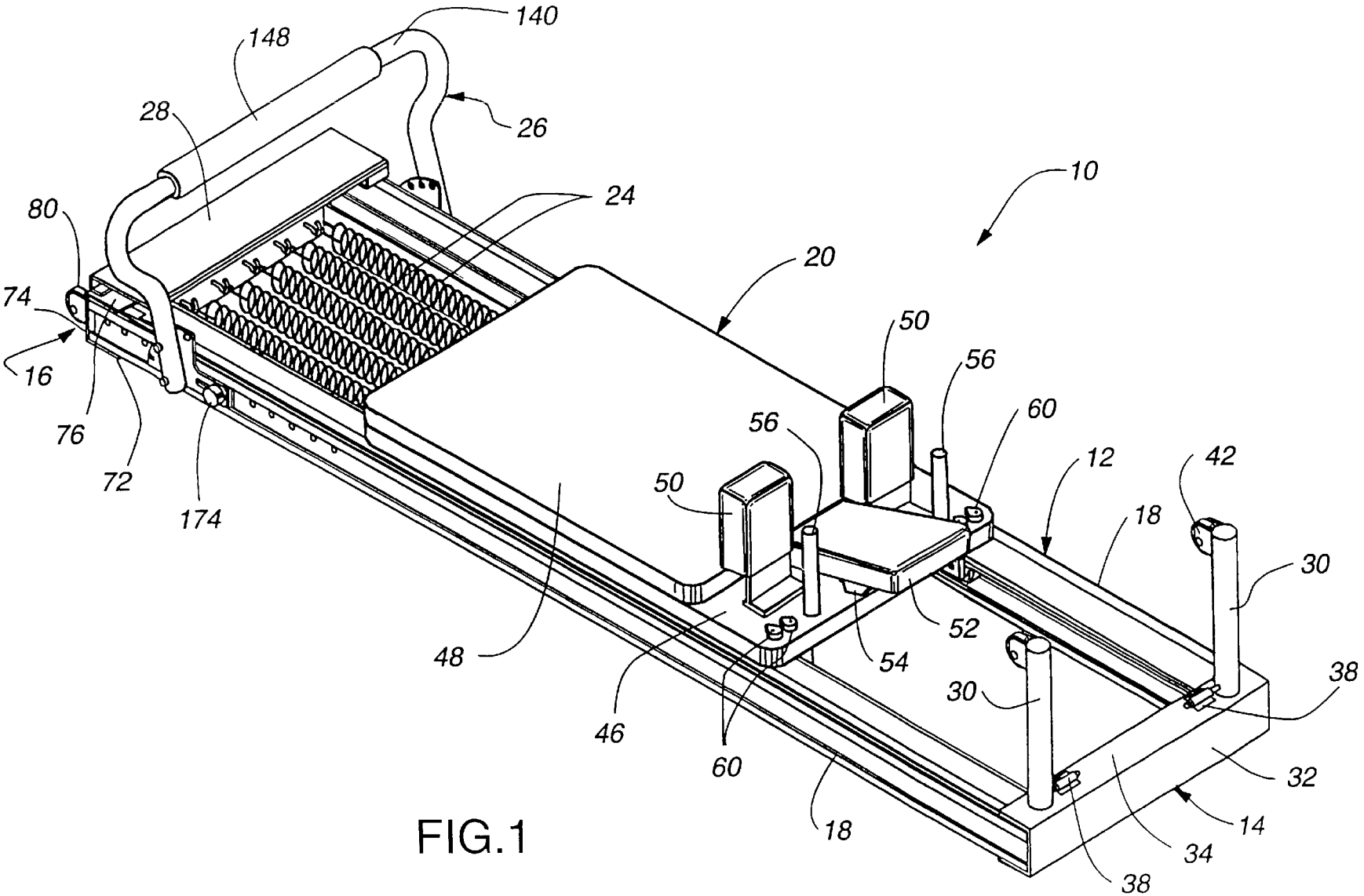
FIG. 1 is an upper perspective view of a first embodiment of the reformer exercise apparatus in accordance with the present invention with the carriage shown in a partially tensioned position away from the spring anchor assembly at the foot end of the frame.
Figure 2:
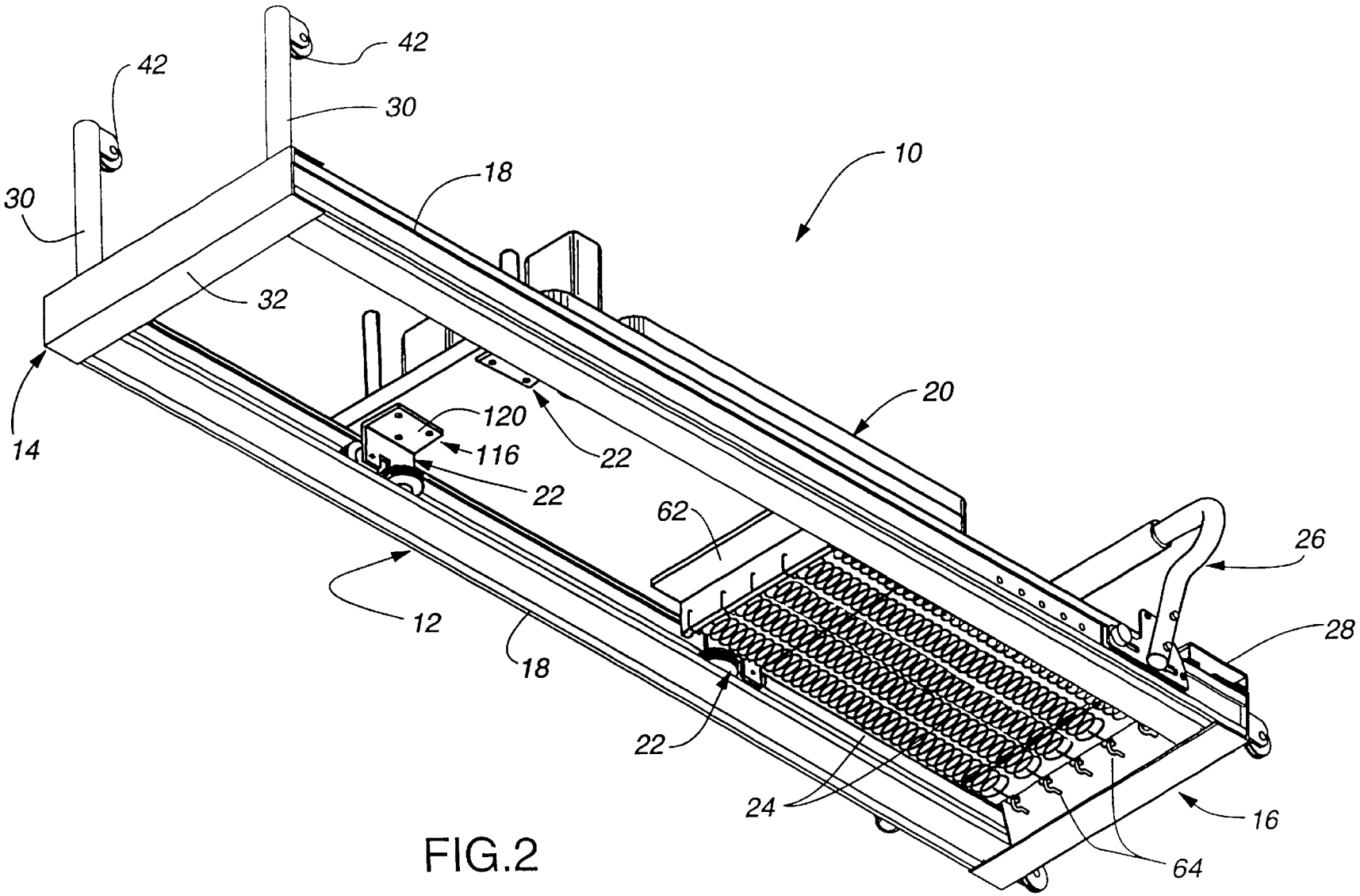
FIG. 2 is a bottom perspective view of the reformer exercise apparatus shown in FIG. 1.

An exercise apparatus 10 in accordance with a first embodiment of the present invention is shown in upper and lower perspective views in FIGS. 1 and 2 respectively, The exercise apparatus 10 comprises a generally rectangular frame 12 having a head end 14 and a foot end 16 and a pair of parallel track or rail members 18 separating the head end 14 from the foot end 16.

A movable carriage 20 rides on four roller wheel assemblies 22 fastened to the underside of the carriage 20. These wheel assemblies 22 roll on the track members 18 to support and guide movement of the carriage 20 back and forth along the track members 18 of the frame 12. A plurality of elastic members, e.g., springs 24 are selectively connected between the carriage 20 and the foot end 16 to bias the carriage 20 toward the foot end 16.

A foot bar assembly 26 is removably fastened to the frame 12 near the foot end 16 so as to provide a stationary support for a user to push against in order to move the carriage 20 back and forth along the track members 18. The foot end 16 also includes a flat foot platform 28 for a user to place one foot on while the other foot is placed on the carriage 20 for standing exercises on the apparatus 10.

The head end 14 is designed to space the rail members 18 rigidly apart and also support a pair of removable arm posts 30. The head end 14 is preferably a rectangular box tubular extrusion member 32 made preferably of aluminum permanently fastened to the head ends of the rail members 18. The extrusion member 32 has a cutout at each end to receive the head end of each of the rail members 18. The top side 34 of the tubular box extrusion member 32 as an aperture therethrough aligned with a corresponding vertical bore through the head end of each of the rail members 18. The aperture in the extrusion member 32 and the bores through the rail members 18 form a pair of sockets 36, as best shown in the exploded view of FIG. 9, for receiving the bottom ends of the arm members 30. A latch pin assembly 38 mounted on the top 34 of the head end extrusion member 32 adjacent each arm member 30 secures the arm members 30 in the sockets 36 by the pin sliding horizontally into a mating hole 40 formed in the lower portion of the arm member 30. The upper end of each of the arm members 30 supports a pulley assembly 42. The pulley assemblies 42 in turn each has a hand cord 44, as shown in FIG. 10, threaded therethrough which is fastened to the carriage 20.

Referring back to FIGS. 1 and 2, the carriage 20 comprises a flat support platform 46 which has a generally rectangular shape. A cushion pad 48 is secured to an upper surface of the platform 46. A pair of shoulder stops 50 are spaced apart near one end of and fastened to the rectangular platform 46. These shoulder stops 48 engage with a user's shoulders when the user lies on his or her back on the carriage 20 while exercising on the apparatus 10. A padded headrest 52 is fastened via a hinge at a base end to the platform 46 between the shoulder stops 48. A trapezoidal shaped hinged block 54 is fastened to the underside of the headrest permitting a user to adjust the incline of the headrest 52 between three positions. A pair of upright posts 56 on either side of the headrest 52 provide a parking spot for the hand grip loop 58 at one end of each of the hand cords 44 (see FIG. 10) when they are not in use. The other ends of the cords 44 are adjustably locked between cam lock rollers 60.

Referring specifically to FIG. 2, an elongated spring support or anchor angle bracket 62 is fastened to the underside of the platform 46. To this bracket 62 are fastened one end of each of the springs 24. The other end of each of the springs 24 may be selectively fastened to either a hook 64 projecting from the vertical side of the end wall member 16 or around an upright spool shaped post 66 (see FIG. 6) fastened to the upper surface of the end wall member 16.

The end wall member 16 includes an elongated metal tubular extrusion 68, preferably aluminum, which has a rectangular cross section, made up of a head wall 70, a bottom wall 72, a foot wall 74, and a top wall 76. A portion of each end of the head wall 70 of the tubular extrusion 68 is cut away forming a pair of recessed areas, each sized to receive the foot end of one of the track members 18. The track members 18 are fastened in the recesses to the extrusion 68 by welding, adhesive bonding or other suitable means. The vertical head wall 70 of the extrusion 68 has a plurality of hooks projecting toward the carriage 20. These hooks 64 are positioned to engage and anchor the foot ends of the springs 24 to the end wall 18. Similarly, the top wall 76 has the plurality of spindle shaped posts 66 mounted thereon which provide an alternate fastening point for the springs 24. The location of the hooks 64 on the vertical head wall provides a relaxed anchor for the springs 24 when the carriage 20 is fully retracted toward the foot end 16. The location of the posts 66 along the horizontal top wall 76 provides an alternative anchor point for the springs 24 which tensions the springs 24 and thus pre biases the carriage 20 toward the foot end 16 prior to a user exerting any force against the foot bar assembly 26.

Figure 4:
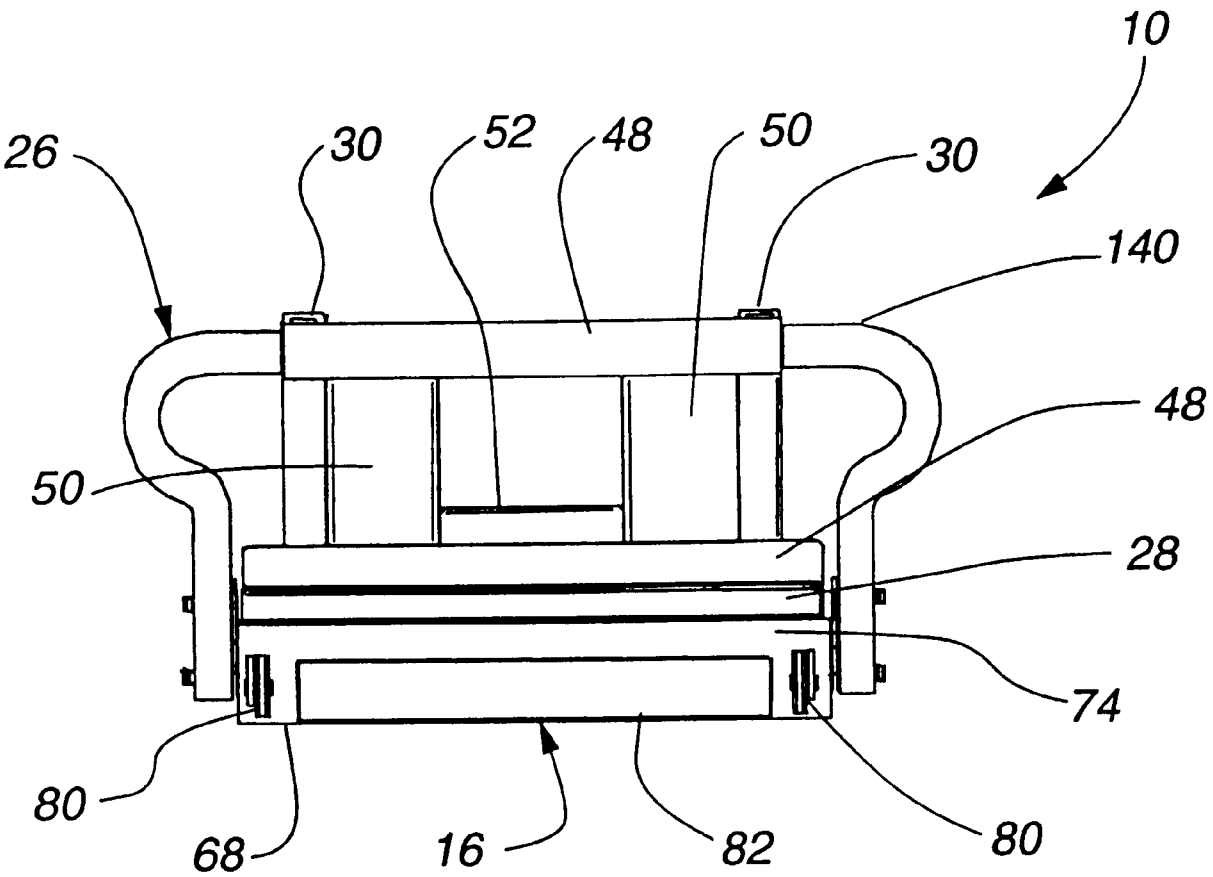
FIG. 4 is an end view of the foot end of the apparatus according to the present invention as shown by the line 4—4 in FIG. 3.

The foot end 16 further has the horizontal foot support platform 28 fastened to the top wall 76 of the extrusion 68. This platform 28 is preferably an elongated plate having bent sides to form a generally C shaped channel cross section. One of the sides, facing the carriage 20, includes a cutout 78 to permit the user to access, i.e., reach beneath and position springs 24 on the posts 66 as can be envisioned with reference to FIG. 6. As shown in the end view of FIG. 4, fastened to the vertical foot wall 74 of the extrusion 68 are a pair of wheel assemblies 80. These wheel assemblies 80 permit the apparatus 10 to be easily transported by simply lifting the head end 14 until the wheels engage the ground and then rolling the apparatus as one would roll a wheelbarrow. Finally, an upwardly open channel shaped plate 82 is fastened horizontally to the vertical foot wall 74 between the wheel assemblies 80. This plate 82 provides a slot to receive and support a bottom edge of a jump board 84 as shown in FIG. 10.

The track or rail members 18 are shown in cross sectional views in FIGS. 5–8. As particularly shown in FIG. 5, each track member 18 is preferably an aluminum extrusion 88 having a pair of spaced upright longitudinal ribs 90 and 92 forming a closed box mid section 94 between a generally flat top wall 96 and a generally flat bottom wall 98. The top wall 96 extends inward and ends in a downward extending curved portion 100. The top wall 96 further extends horizontally outward and terminates in a vertical upper outer wall 102. A longitudinal gusset 104 between the first rib 90 and the upper outer wall 102 forms a closed box channel 106 extending parallel to the mid section 94. The longitudinal gusset 104 reinforces the upper outer wall 102.

The bottom wall 98 extends horizontally outward to a elongated vertical lower outer wall 108. The outer wall 108 is vertically aligned with the upper outer wall 102. The top wall 96, bottom wall 98, upper outer wall 102 and lower outer wall 108 together form a elongated C shaped channel outer section extending parallel to the mid section 94. This outer section also may be viewed as forming shallow, elongated "T" shaped slot 110.

The bottom wall 98 also extends horizontally inward from the mid section 94 to a vertical inner wall 112 which is vertically aligned with the end of the curved end 100 of the top wall 96 of the extrusion 88 to form a C shaped inner section forming support/guide channel 114 which opens opposite to the C shaped outer section or slot 110. The support/guide channel 114 receives the wheel assemblies 22 as will be further described below.

Figure 8:
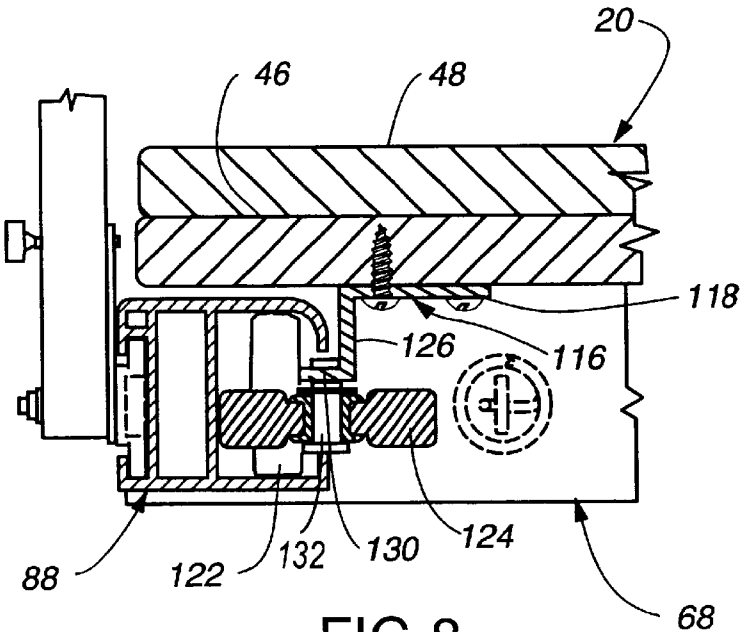
FIG. 8 is a sectional view of the apparatus shown in FIG. 3 taken along the line 8—8 in FIG. 3.

Referring now to FIG. 2 and sectional FIGS. 7 and 8, construction of the carriage 20 wheel assemblies 22 will be described. Each of the wheel assemblies 22 comprises a sheet metal support bracket 116 which has a horizontal mounting portion 118 fastened to the underside of the carriage platform 46 via screws 120, a bearing supported support roller wheel 122, and a bearing supported guide roller 124. The bracket 116 has a support roller mounting portion 126 bent downward at a right angle and extending vertically from the mounting portion 118, as is best shown in the sectional view of FIG. 7. A fixed axle 128 for the support roller 122 extends horizontally outward from the vertical mounting portion 126. The bracket 116 also has a guide roller portion support portion 130 which is bent at a right angle from the vertical mounting portion 126 so as to extend outward horizontally. A vertically extending guide roller axle 132 has its upper end fastened to the guide roller support portion 130. The lower end of the guide roller axle 132 passes through and is fastened to the roller bearing sleeve of the guide roller 122.

Figure 5:
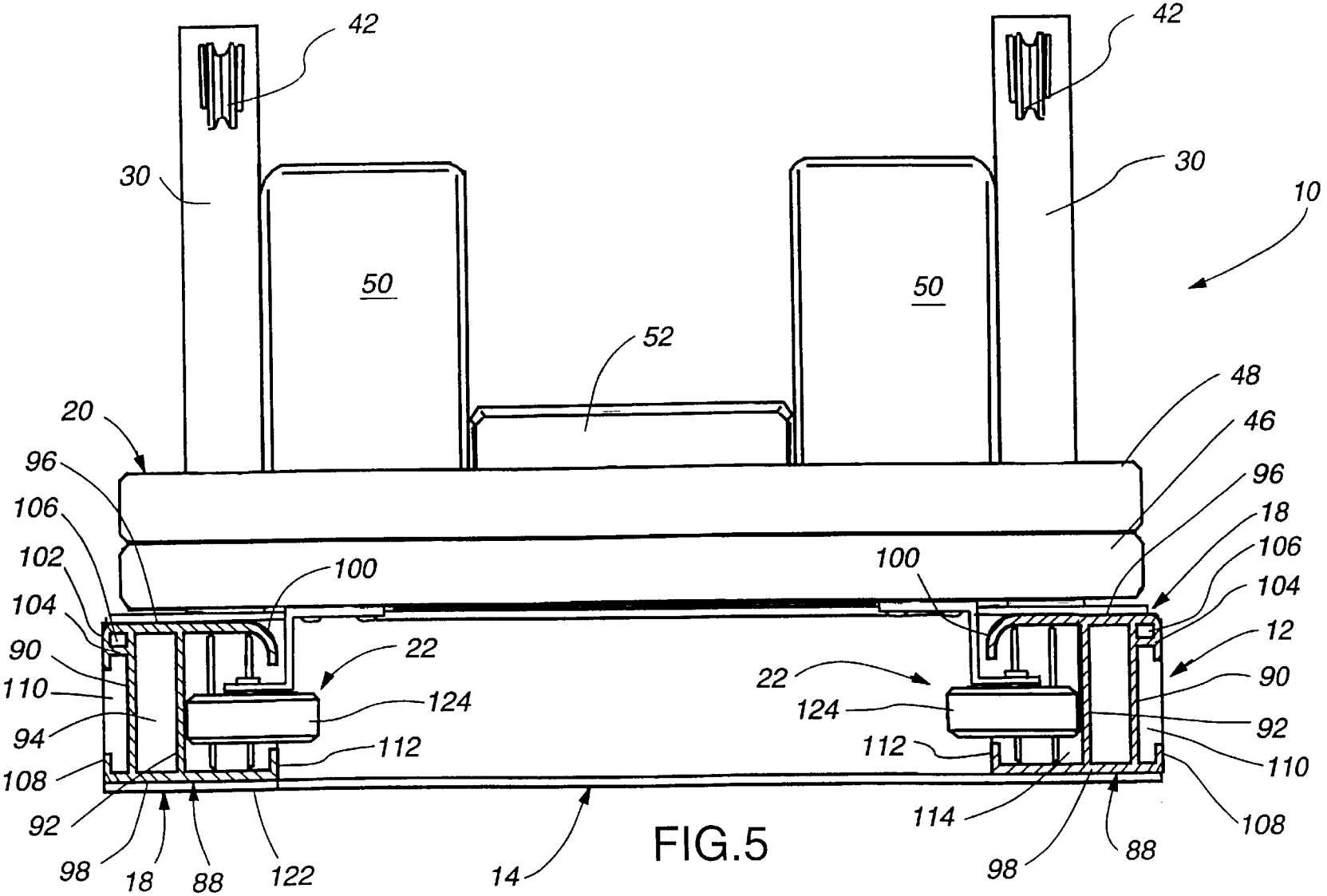
FIG. 5 is a sectional view of the apparatus shown in FIG. 3 taken along the line 5—5 in FIG. 3.
Figure 7:
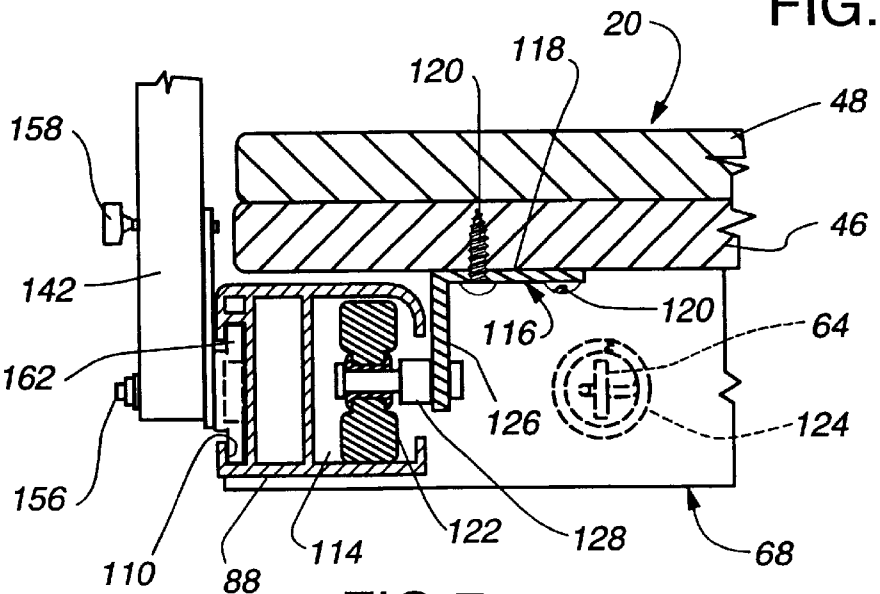
FIG. 7 is a sectional view of the apparatus shown in FIG. 3 taken along the line 7—7 in FIG. 3.

Referring now specifically to the sectional view of the apparatus 10 taken through the support roller wheel 122 shown in FIG. 7 and the sectional view of FIG. 5, this wheel 122 rides in the support channel 114 and carries one quarter of the weight of the carriage 20 and the user (not shown) as there are four wheel assemblies 22, each mounted adjacent a corner of the carriage platform 46. As best shown in FIGS. 5 and 8, the guide rollers 124 also ride in the support channel 114, but do not ride against the bottom wall 98 of the extrusion 88. Instead, the guide rollers 124 roll along the vertical longitudinal rib 92 of the extrusion 88 thus aligning the carriage 20 side to side on the rail members 18. These guide rollers 124 ensure that minimal friction is exerted between the carriage 20 and the rail members 18 for an exceptionally smooth back and forth movement of the carriage 20 on the rail members 16 of the apparatus 10 during use. Further, this arrangement, with both the support roller wheels 122 and the guide rollers 124 traveling in the guide channels 114 positively prevents the carriage 20 from tilting up or binding against the rail members 18 when a user does not properly distribute his or her weight symmetrically on the carriage 20. This configuration provides a unique safety feature to the present invention. The carriage 20 is, in essence, fastened to the rail members 18 at all times during normal operation of the apparatus 10. Further, when the head end 14 is lifted so as to engage the wheels 80 on the foot end 16 with the floor surface so that the apparatus 10 may be "wheelbarrowed" to a storage location, the carriage 20 remains fastened to the rail members 18. To facilitate such movement, a handle (not shown) may be fastened to the outer wall of the head end 14.

Figure 11:
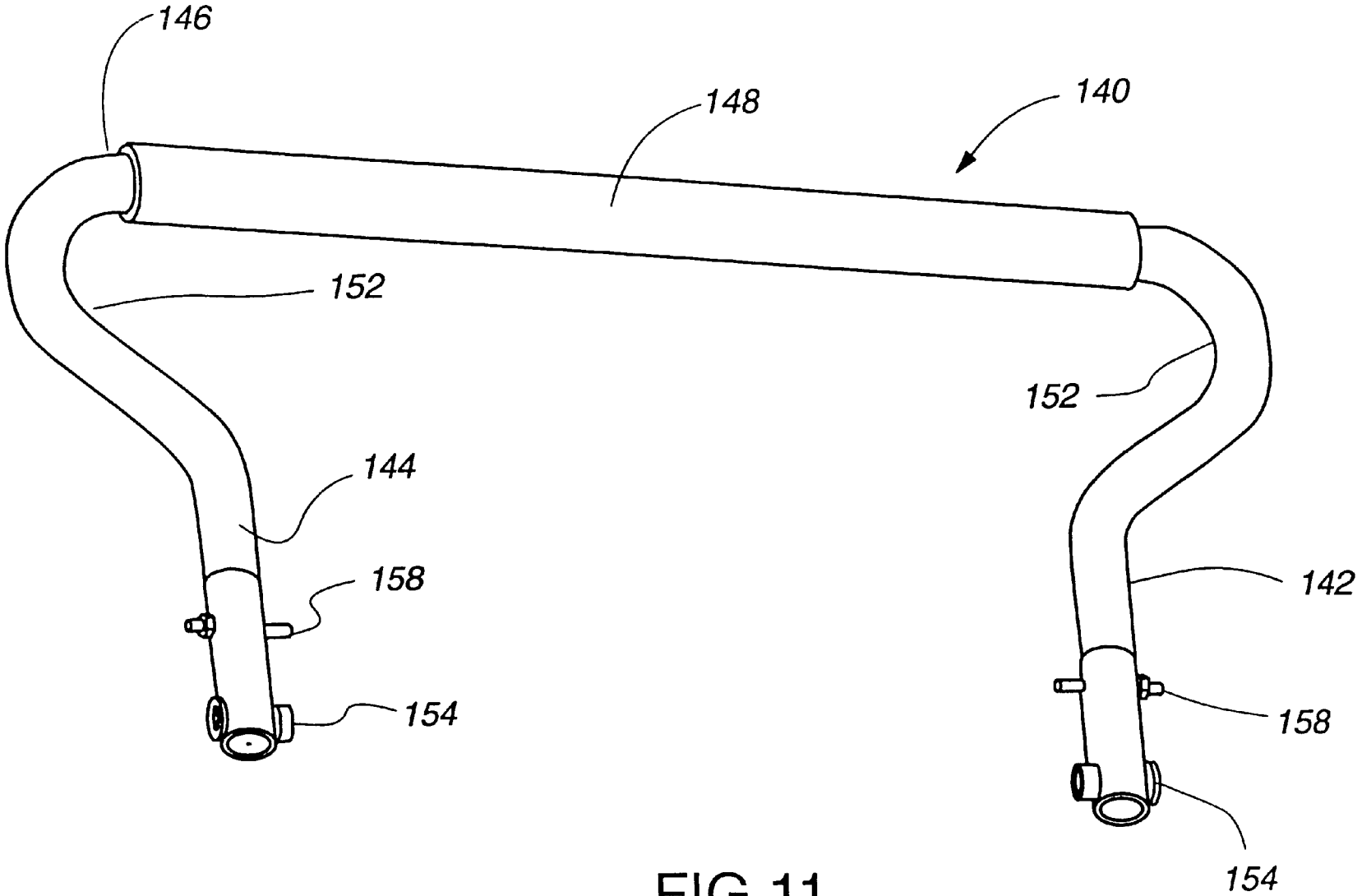
FIG. 11 is a separate perspective view of the foot bar in both embodiments of the apparatus in accordance with the present invention.
Figure 12B:
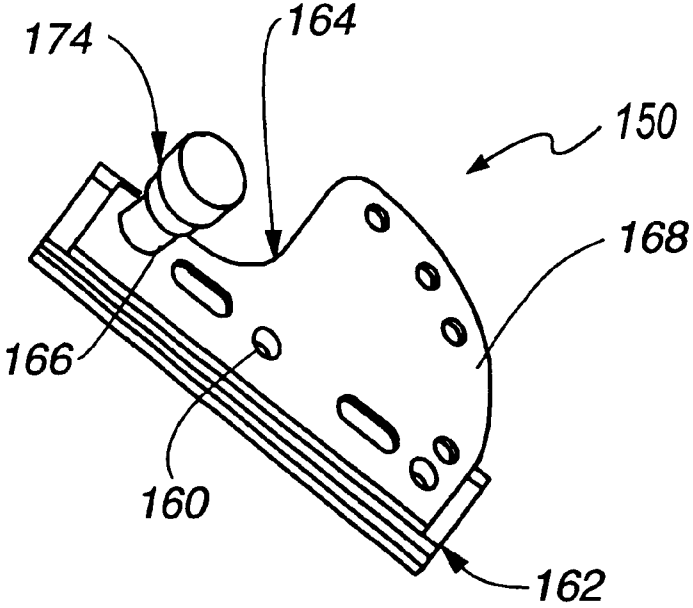
FIG. 12 is a separate perspective view of a pair of foot bar support bracket assemblies in accordance with the present invention.
Figure 12A:
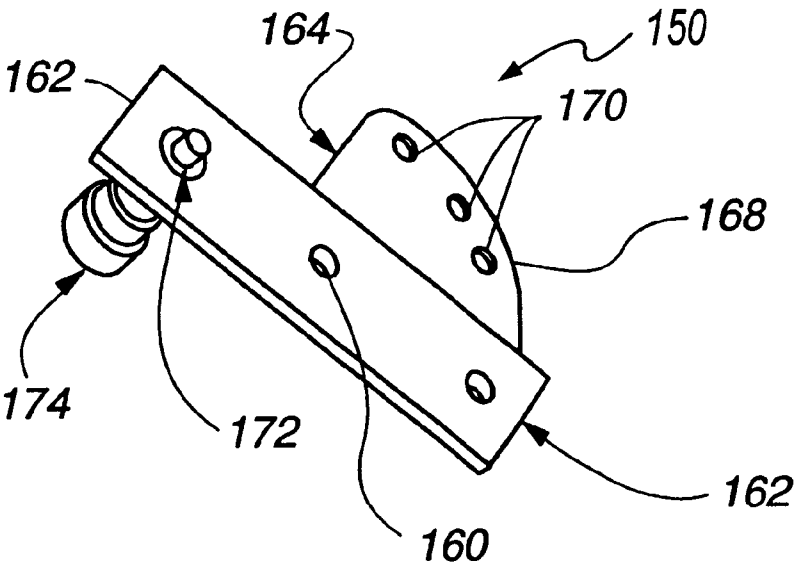

The foot bar assembly 26 comprises a generally U shaped foot bar 140, preferably made of tubular aluminum, having a pair of spaced parallel leg portions 142 and 144 and a foot bar portion 146 therebetween and a pair of adjustable support bracket assemblies 150. A padded sleeve 148 over the foot bar portion 146 provides a cushion support for a user's foot. The foot bar assembly 26 is shown in FIGS. 1–4, and 9 and 10 assembled onto the rail members 18 at the foot end 16 of the frame 12. FIGS. 11 and 12 show the foot bar 140 and support bracket assemblies 150 in perspective separated from the frame 12.

The foot bar portion 146 has an S shaped recurve region 152 at each end thereof joining the leg portions 142 and 144 so that the straight portion of the foot bar portion 146 extends fully across the rail members 18 and, when the foot bar 140 is rotated so as to lie horizontally over the foot end 16, the bar 140 clears the wheels 80. The recurve region 152 further provides a more rigid structure to the foot bar 140 than a simple straight right angle bend between the leg and foot bar portions. At each distal end of the leg portions 142 and 144 is a transverse bearing sleeve 154. An pivot pin 156 is fastened through the sleeve 154 into a threaded central pivot bore 160 in one of the support brackets 150. A spring loaded stop pin 158 is fitted through a corresponding bore through each of the leg portions 142 and 144 spaced above the pivot sleeve 154. This stop pin 158 is used to adjust the vertical position of the foot bar portion 146 of the bar 140 as more fully described below.

Figure 6:
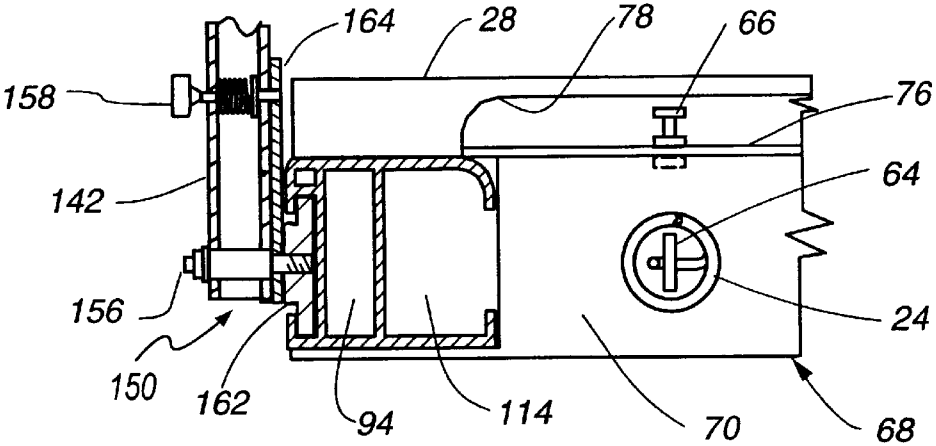
FIG. 6 is a sectional view of the apparatus shown in FIG. 3 taken along the line 6—6 in FIG. 3.

The support brackets 150 are separately shown in FIG. 12 and in installed sectional view in FIG. 6. Each of the support bracket assemblies comprises an elongated anchor bar 162 having a generally T shaped cross section sized complementary to the T-slot 110 in the extrusion 88 so that the anchor bar 162 can slide back and forth in the T-slot 110. Fastened to the base of the T shaped cross section of the anchor bar 162 is a support plate 164 having an elongated base portion 166 extending along the base of the anchor bar 162 and an arcuate portion 168 extending parallel to the top of the anchor bar 162. This arcuate portion 168 has a series of holes 170 spaced at different angles from the threaded central pivot bore 160 which extends through both the arcuate portion and the anchor bar 162. The holes 170 are positioned to receive the spring loaded stop pin 158 to lock the position of the foot bar 140 at a particular desired height above the rail members 18. At least one of the holes 170 is directly above the threaded central pivot bore 160 providing a vertical position of the foot bar 140. Another of the holes 170 is horizontally aligned with the central pivot bore 160 to completely collapse the foot bar 140 around the foot end 16 of the frame 12.

At the other end of the base portion 166 of the support plate 164 is a through bore 172 which is aligned with and passes through the anchor bar 162. This bore 172 receives a spring loaded stop pin assembly 174. The pin of the stop pin assembly 174 selectively fits into one of a plurality of horizontally spaced apart holes through longitudinal rib 90 of the extrusion 88 of rail member 18. The anchor bar 162 of the foot bar assembly 26 slides along in the T-slot 110. The spring loaded stop pin assembly 174 stops the anchor bar 162 at a desired position along the rail member 18.

Figure 3:
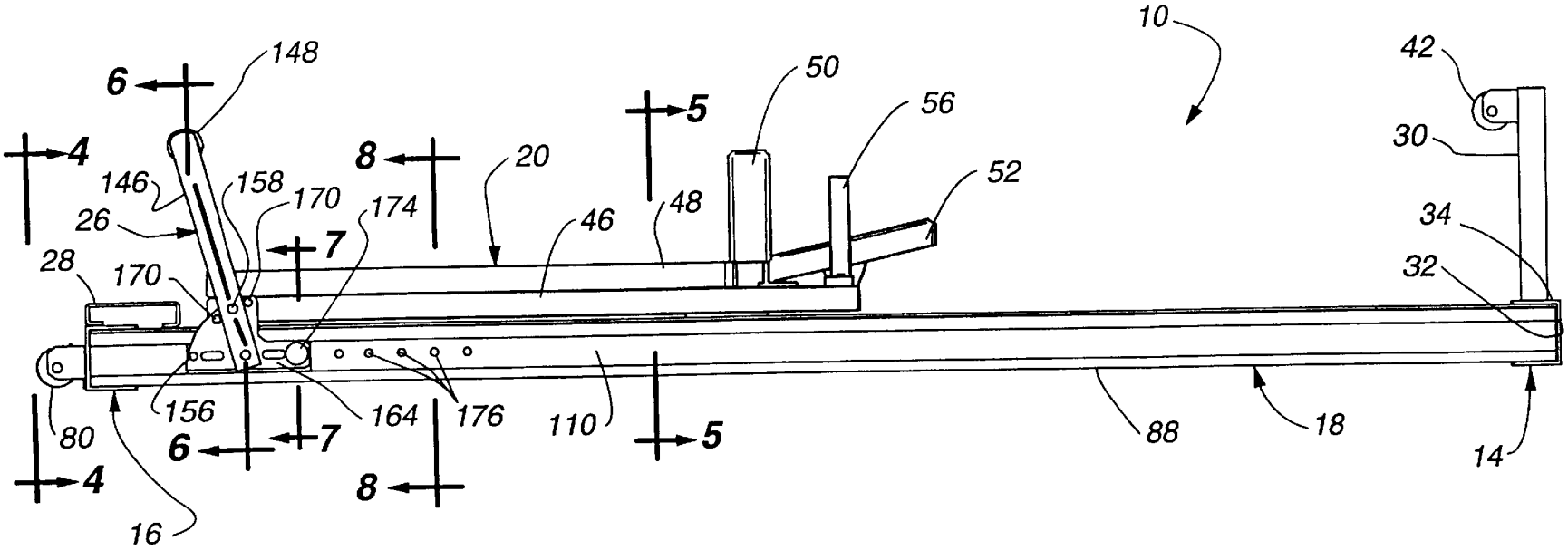
FIG. 3 is a side view of the reformer exercise apparatus shown in FIGS. 1 and 2 with the carriage shown fully relaxed and retracted against the foot end of the frame.

The foot bar assembly 26 may be adjusted to any of the several longitudinal positions adjacent the foot end 16 of the frame 12 as indicated by the position of the holes 170 in FIGS. 1–3. In addition, the foot bar assembly 26 may be positioned with the anchor bar 162 fully against the foot end of the foot end extrusion 68. In this position, as is shown in FIG. 10, the foot bar assembly 26 may be used to support the upper portion of the removable jump board 84.

The apparatus in accordance with the present invention may also be configured to be taken apart and transported easily by car. In the second embodiment 200 of the invention shown in FIGS. 9 and 10, the take down version of the apparatus is shown. The apparatus 200 is identical to apparatus 10 described above, except that the rail members 18 are sectioned into two separate in line sections 18*a* and 18*b*. Thus the numbering and configuration of the remainder of the apparatus 200 corresponds to that described above with reference to the first embodiment 10 and thus will not be repeated.

Figure 9:
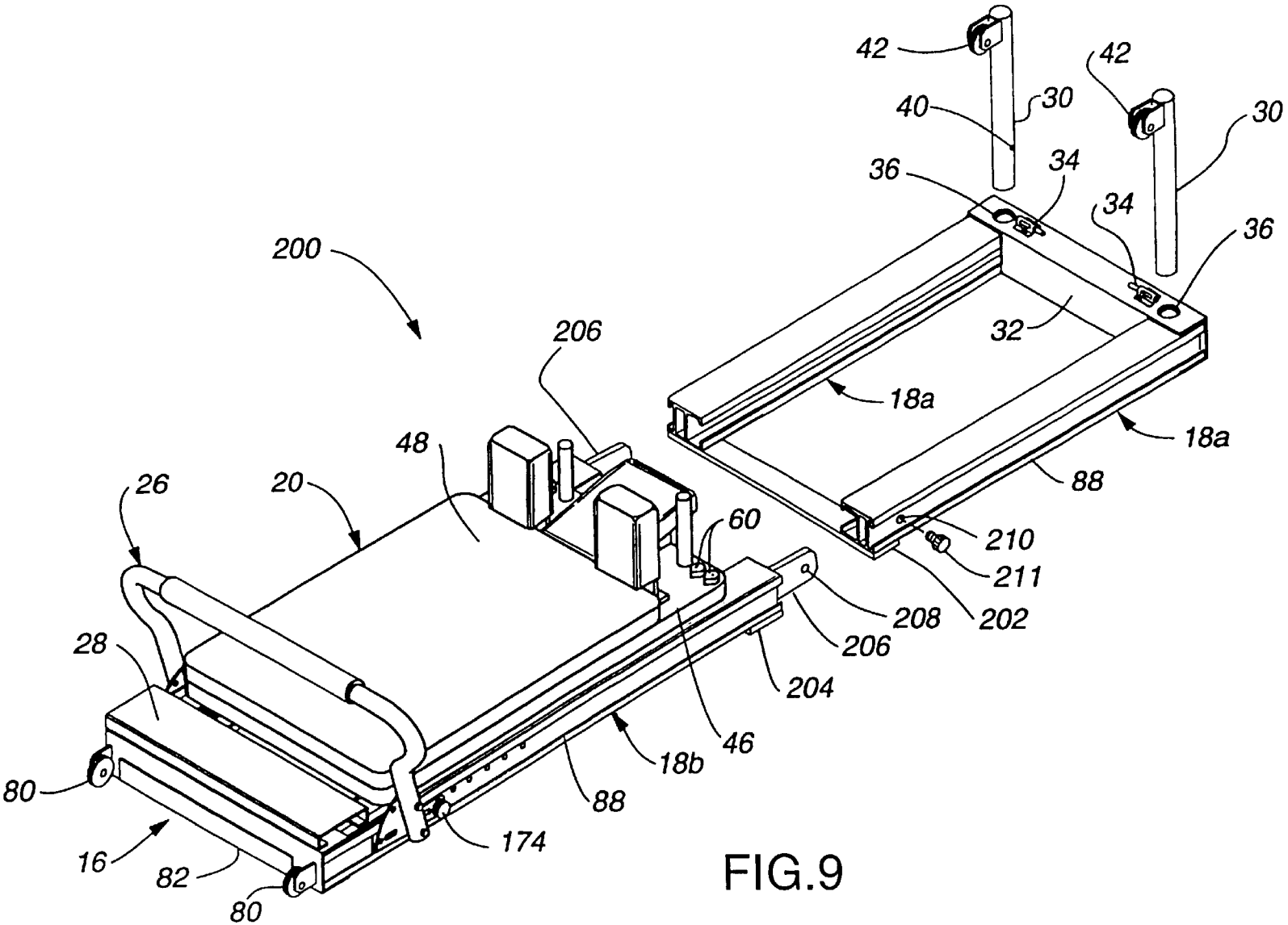
FIG. 9 is a perspective exploded view of a second embodiment of the reformer apparatus in accordance with the present invention.
Figure 10:
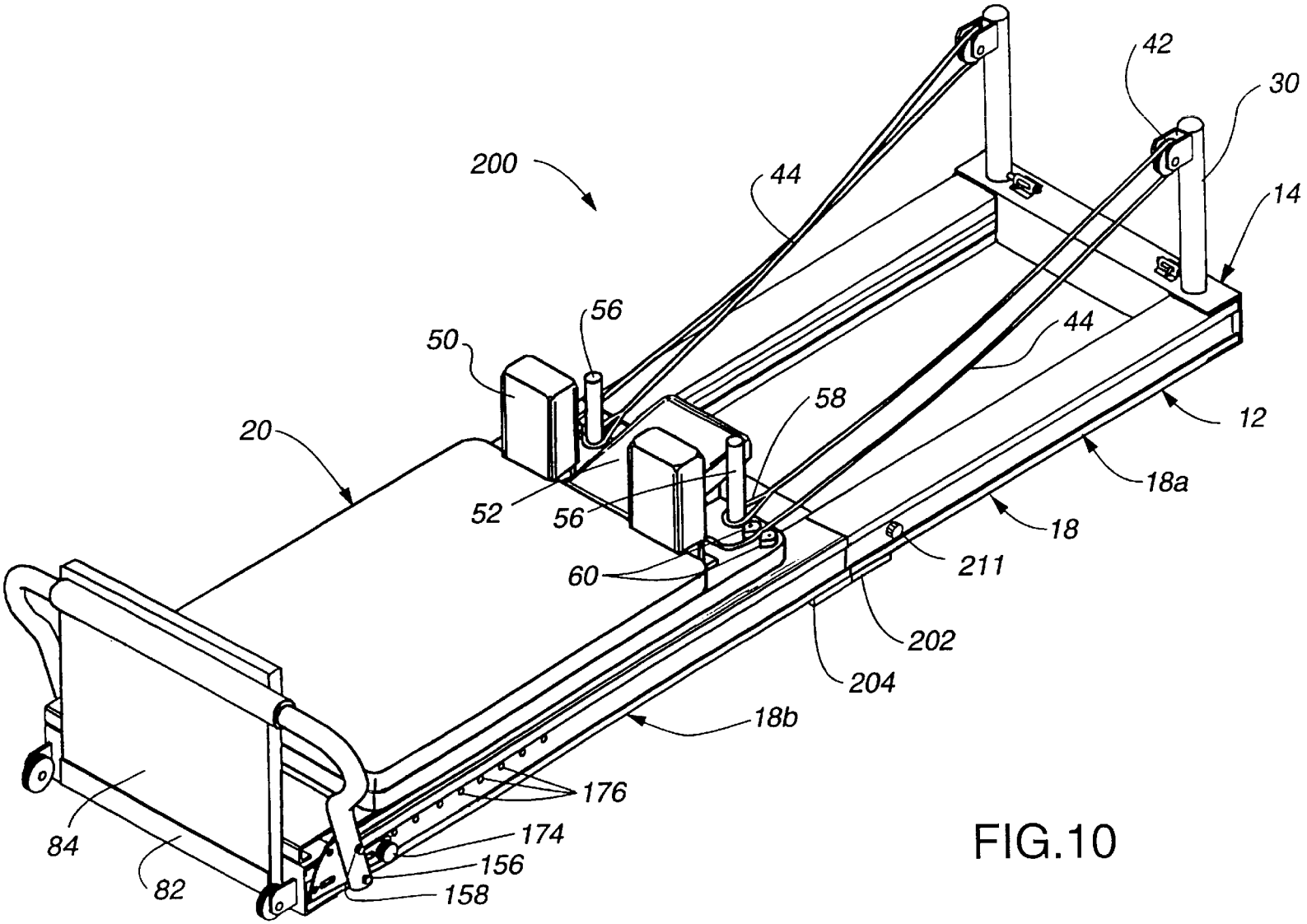
FIG. 10 is an assembled perspective view of the second embodiment of the reformer apparatus in accordance with the present invention.

The apparatus 200 is shown in an exploded view in FIG. 9 and an assembled view in FIG. 10. Each of the middle ends of the rail members 18*a* are joined with the other by a horizontal end plate 202. Each of the middle ends of the rail members 18*b* are similarly joined with the other by a horizontal end plate 204. These end plates 202 and 204 rigidify the rail structure. An elongated bayonet type tongue 206 extends from the mid section 94 of the rail member 18*b*. This tongue 206 is sized to slip into the mid section 94 of the rail member section 18*a*. The tongue 206 has a transverse bore 208 therethrough which aligns with a corresponding hole 210 through the outer longitudinal rib 90 of the extrusion 88 of rail member section 18*a* when the sections 18*a* and 18*b* are fully mated. The transverse bore 208 is preferably threaded. When the two sections are joined, a threaded anchor bolt 211 may hand tightened in the transverse bore 208 through the hole 210 to fasten the assembled apparatus 200 together. For transport, one simply unbolts the two halves, collapses the foot bar assembly 26 around the foot end 16, removes the arm members 30 from the sockets 36, and places the two sections in one's vehicle. Alternatively, the tongues 206 may include a hinged portion (not shown) which permits the two sections 18*a* and 18*b* to be pulled apart and then folded for transport.

A third embodiment 300 of the exercise apparatus in accordance with the present invention is shown in FIGS. 13 through 16. In these drawings, like numerals are used to identify like components previously described and shown above. The exercise apparatus 300 is similar to the first and second embodiments 10 and 200 described above and shown in FIGS. 1 through 10 except that in this embodiment the posts 56 have been removed, the shoulder stops 50 are removable and permit lateral selection of shoulder stop spacing between two positions, the head end and foot end of the frame 302 are constructed of the same extrusion as the side rails 18, and the foot bar 303 is removable from pivoting support members 304 or "spuds" fastened to the support bracket 164 so that different shapes of foot bars may be utilized. Finally, the removable shoulder stops 50 are stored on a bracket on the inner face of the head end and the arm posts 30 are stored in bores through the head end so that the posts 30 extend into the support channel 114 of the rail 18. These storage features result in an apparatus, prepared for storage, which is only about 5½ inches high and permits a number of the apparatuses to be compactly stacked, one on another, while keeping all of the components of each apparatus together.

Figure 13:
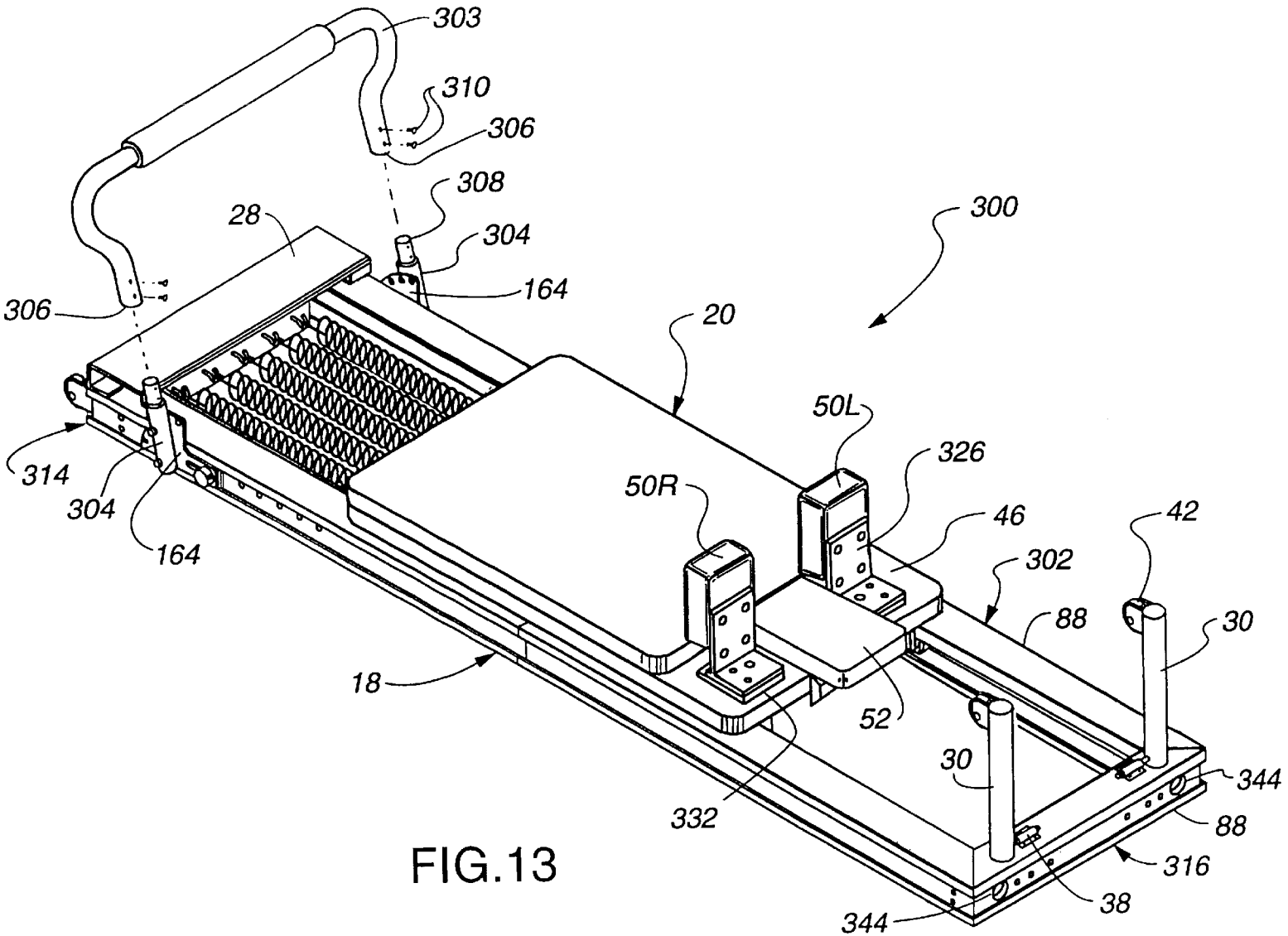
FIG. 13 is a perspective view of a third embodiment of the exercise apparatus in accordance with the present invention.

Referring now to FIG. 13, a perspective view of exercise apparatus 300 is shown with the foot bar 303 shown separated from the support members 304. Each of the foot bar support members 304 is in turn fastened to one of the foot bar support plates 164 as above described. The foot bar 303 has two parallel legs which form sockets 306 which telescopically slide over and onto the free ends 308 of the foot bar support members 304. A pair of set screws 310 are used to fasten the foot bar 303 securely to the support members 304.

Figure 16:
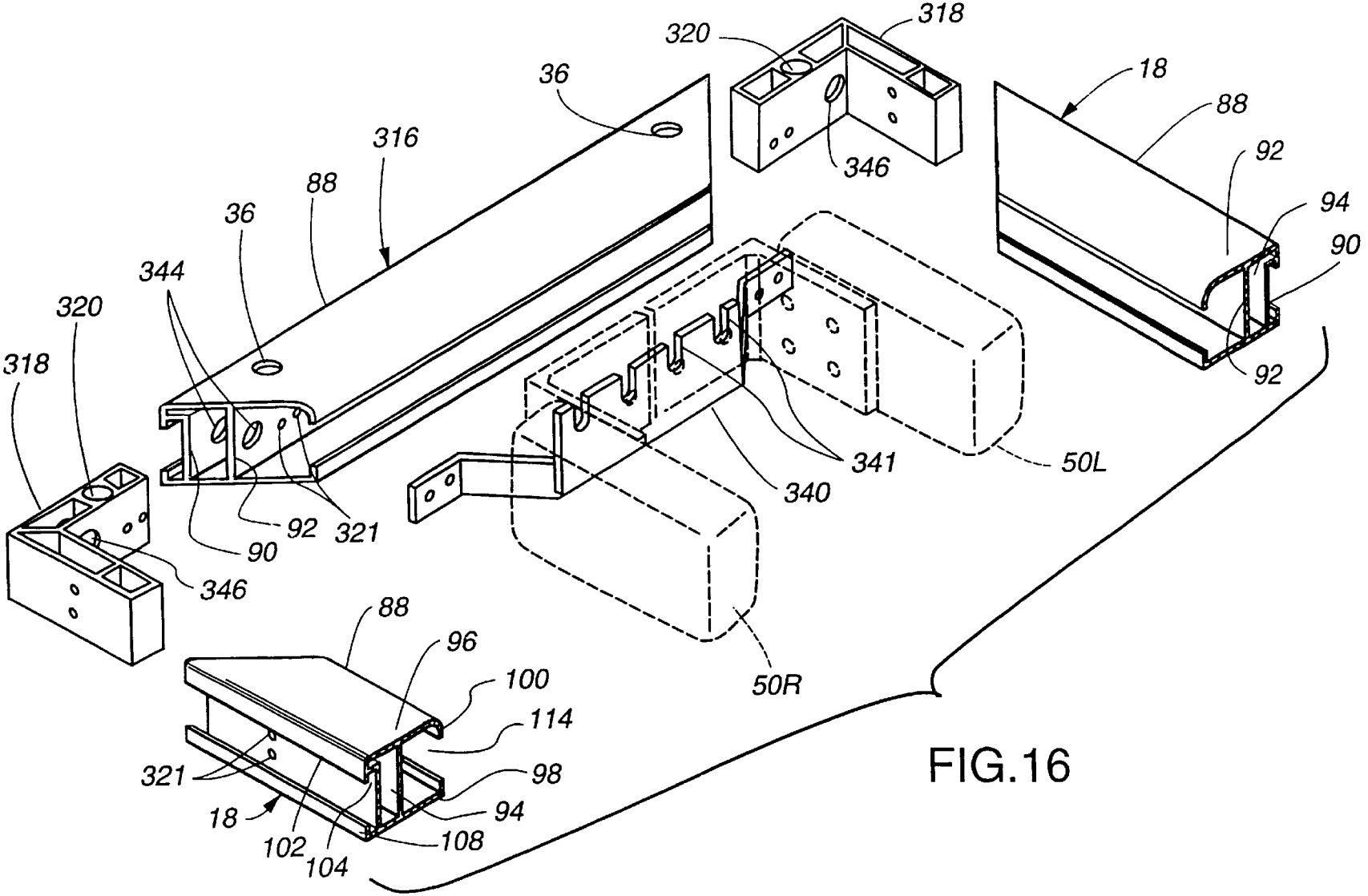
FIG. 16 is an enlarged exploded view of the head end of the frame of the exercise apparatus in accordance with the third embodiment of the present invention showing the miter clamp arrangement for fastening the rails and end members together.

The exercise apparatus 300 includes a frame 302 made of four sections of metal extrusion 88 as in the rail members 18 of embodiments 10 and 200 described above. Each extrusion 88 forming the rail members 18, the foot end member 314 and the head end member 316 have a cross section as shown in FIG. 16, similar to that shown in the cross sectional views in FIGS. 5–8. Again, the extrusions 88 each have a pair of spaced upright longitudinal ribs 90 and 92 forming a closed box mid section 94 between a generally flat top wall 96 and a generally flat bottom wall 98. The top wall 96 extends inward and ends in a downward extending curved portion 100. The top wall 96 further extends horizontally outward and bends downward forming a vertical upper outer wall 102. In this embodiment, the longitudinal gusset 104 between the first rib 90 and the upper outer wall 102 does not form a closed box channel 106 extending parallel to the mid section 94 as in the first two embodiments. The longitudinal gusset 104 reinforces the upper outer wall 102 and, in this particular embodiment 300, connects the upper end of the rib 90 to the outer wall 102, as the formation of the small, closed box channel 106 as in the first two embodiments by extending the rib 90 to the underside of the top wall 96 unnecessary to maintain the requisite strength and rigidity required of the extrusion 88 for its intended use.

The bottom wall 98 extends horizontally outward to a elongated vertical lower outer wall 108. The outer wall 108 is vertically aligned with the upper outer wall 102. The top wall 96, bottom wall 98, upper outer wall 102 and lower outer wall 108 together form a elongated modified C shaped channel outer section extending parallel to the mid section 94. This outer section also may be viewed as forming a shallow, elongated "T" shaped slot 110. The bottom wall 98 also extends horizontally inward from the mid section 94 to a vertical inner wall 112 which is vertically aligned with the end of the curved end 100 of the top wall 96 of the extrusion 88 to form a modified C shaped inner section forming support/guide channel 114 which opens opposite to the C shaped outer section or slot 110. The support/guide channel 114 receives the wheel assemblies 22 in the rail members 18.

In the head end member 316, the top wall 96 has vertical bores 36 therethrough which open into the box mid section 94. These bores 36 receive the bottom ends of the arm posts 30. FIG. 16, an exploded view of the head end of the apparatus 300, illustrates the joinder of the rail members 18 to the head and foot end members 314 and 316. Although only the head end 316 is shown, it is to be understood that the foot end 314 is similarly structured and assembled in the same manner. The ends of the extrusions 88 are mitered at 45 degrees and are joined by use of an L shaped extruded joint member 318. Joint member 318 has cross sectional outer dimensions of each leg complementary to the dimensions of the mid section 94 of the head end member 316 and the rail member 18 such that when the legs of the joint member 318 are inserted into the mid sections 94 of the rail member 18 and the head end member 316, an extremely rigid and accurate joint is formed. The joint member 318 has a vertical bore 320 therethrough at the location of the bore 36 through the top wall 96 of the head end extrusion. Thus, when the frame is fully assembled, and an arm support 30 is inserted through the bore 36, the lower end of the arm support 30 passes through the bore 320 in the leg of the joint member 318 forming a secure base for the arm support. Optionally, in this embodiment 300, the lock pins 38 may be included on the top of the extrusion 88 or omitted. If desired, the lock pins 38 may be replaced by a through pin arrangement passing horizontally through the ribs 90 and 92, the joint member 318, and the base of the arm member 30.

The foot end member 314 and the head end member 316 are joined to the rail members 18 with the four joint members 318. After assembly of each corner, a pair of screws (not shown) are inserted through appropriate apertures 321 in the vertical rib 90 and in the vertical rib 92 of the extrusions 88 adjacent the ends of each extrusion to rigidly fasten the head and foot ends 316 and 314 to the joint members 318 and thus to the rails 18 and form the rigid frame 302.

The rails 18 may be formed in two separable sections for portability of the apparatus in the trunk of a car as in the second embodiment 200 as is shown in FIGS. 9 and 10. In this instance, brace plates 202 and 204 would preferably be fastened to the undersides of the bottom walls 98 of the extrusions 88 to make the two sections rigid and eliminate the potential for application of excessive stresses on the corners and the joint members 318 therein.

Figure 14:
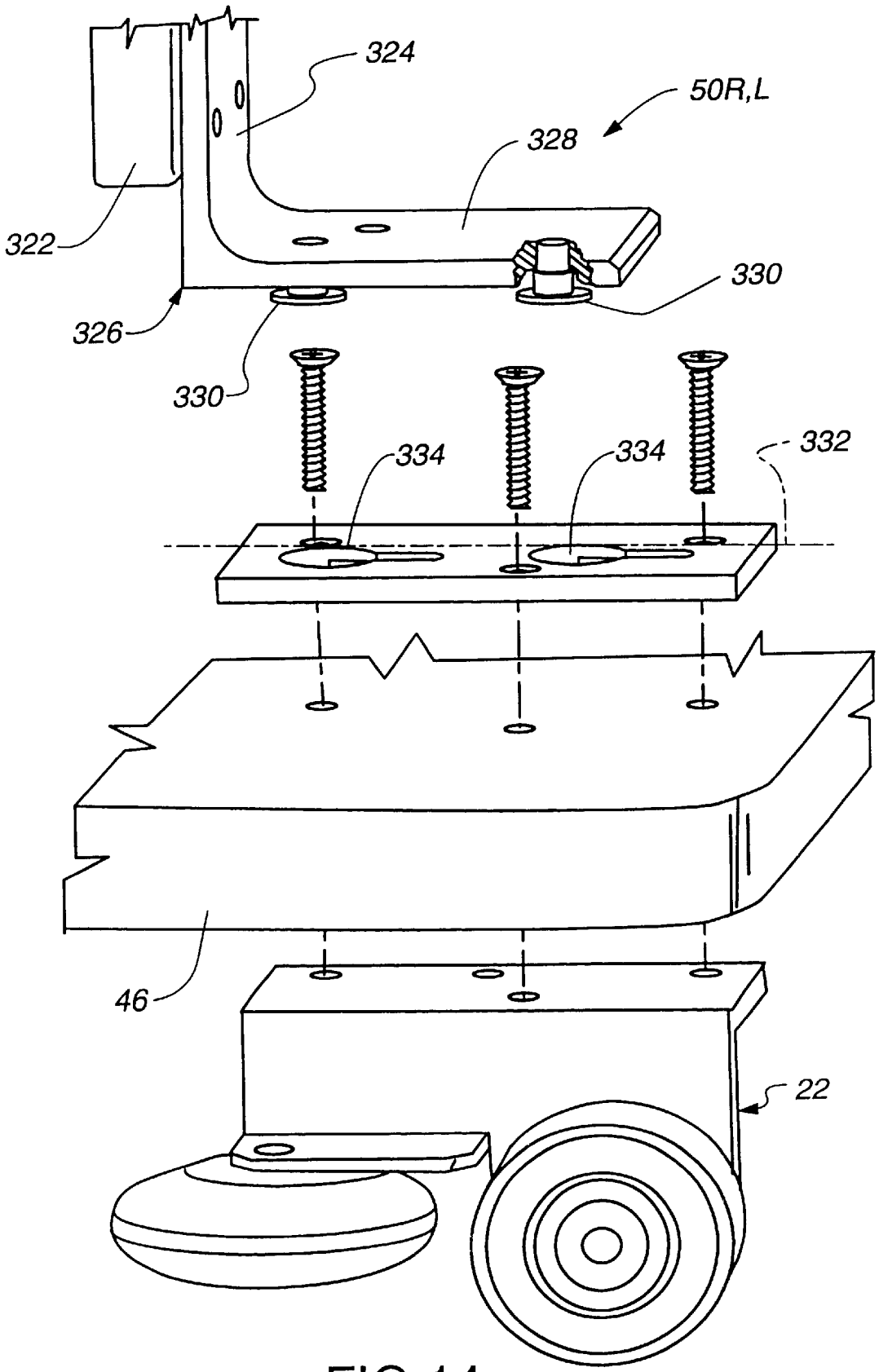
FIG. 14 is an exploded enlarged view showing the mounting arrangement of one of the removable shoulder stops in the third embodiment in accordance with the invention.

Referring now to FIG. 14, the mounting arrangement of the shoulder stops 50R and 50L in accordance with this embodiment of the invention is shown. Each shoulder stop 50 comprises a cushion pad 322 fastened to one side of one leg 324 of an angle bracket plate 326. The other leg 328 of the angle bracket plate 326 has a pair of bayonet pins 330 protruding from its underside. These pins 330 are each laterally spaced to one side of the longitudinal center line of the shoulder stop 50. A complementary rectangular mounting plate 332 is fastened to the upper surface of the carriage platform 46. This mounting plate 332 has a pair of keyway slots 334 formed therein, also spaced to the same side of the longitudinal centerline of the leg 328 of the bracket plate 326, and spaced to receive the bayonet pins 330 therein. The right shoulder stop 50R shown in FIG. 13 has its bayonet pins spaced to the right of the centerline of the angle bracket plate 326. The left shoulder stop 50L shown in FIG. 13 has its bayonet pins spaced to the left of the centerline of the angle bracket plate 326. Consequently, if the shoulder stops 50R and 50L are swapped, the spacing between them will increase. Conversely, if the mounting plates 332 were reversed on carriage platform 46, then, if the shoulder stops 50R and 50L were swapped, the alternative arrangement would produce a narrower spacing therebetween. Accordingly, the user may select a choice between normal lateral spacing and wide lateral spacing with one arrangement of the mounting plates 332, and may alternatively select a choice between normal lateral spacing and narrow lateral spacing by simply swapping the mounting plate locations on the platform 46.

The shoulder stops 50R and 50L and the arm posts 30 preferably are removed and stored when the apparatus 300 is not in use. To prevent interchanging shoulder stops and/or loss of the shoulder stops while the unit is stored, a sheet metal bracket 340, best shown in FIG. 16, is fastened to the inside vertical rib 92 of the extrusion 88 of the head end member 316. This bracket 340 has four U shaped slots 341 along its upper edge to receive the bayonet pins 330 so that the shoulder stops 50 can be removed from the plate 332 and stored as shown by the dashed lines in FIG. 16 and in the side view of FIG. 15.

Figure 15:
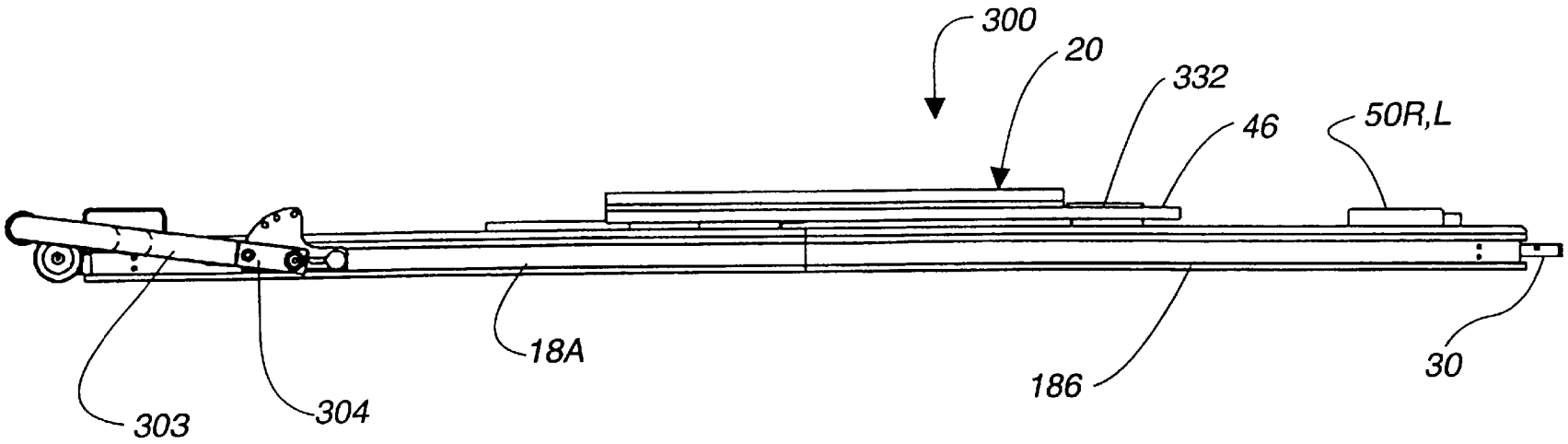
FIG. 15 is a side view of the third embodiment shown in FIGS. 13 and 14 with the shoulder stops and arm posts in storage positions.

The arm posts 30 are also stored in the head end 316 as shown in FIG. 15. The extrusion 88 of the head end member 316 also has a pair of spaced horizontal bores 342 and 344 through both the vertical ribs 90 and 92 and joint member 318 has a horizontal bore 346 therethrough, spaced from the ends of the extrusion such that the bores 342, 344, and 346 are aligned in the head end member 316 when the frame is assembled. The arm posts 30, when pushed through the bores 342, 344 and 346, extend into and along the support channels 114 of the rails 18. The pulleys 42 prevent the arm posts from passing entirely into the support channels 114. Alternatively, a clip may be provided (not shown) in the support channels 114 to hold the arm posts in place.

The foot bar portion 146 has an S shaped recurve region 152 at each end thereof joining the leg portions 142 and 144 so that the straight portion of the foot bar portion 146 extends fully across the rail members 18 and, when the foot bar 140 is rotated so as to lie horizontally over the foot end 16, the bar 140 clears the wheels 80. The recurve region 152 further provides a more rigid structure to the foot bar 140 than a simple straight right angle bend between the leg and foot bar portions. At each distal end of the leg portions 142 and 144 is a transverse bearing sleeve 154. An pivot pin 156 is fastened through the sleeve 154 into a threaded central pivot bore 160 in one of the support brackets 150. A spring loaded stop pin 158 is fitted through a corresponding bore through each of the leg portions 142 and 144 spaced above the pivot sleeve 154. This stop pin 158 is used to adjust the vertical position of the foot bar portion 146 of the bar 140 as more fully described below.

Figure 17:
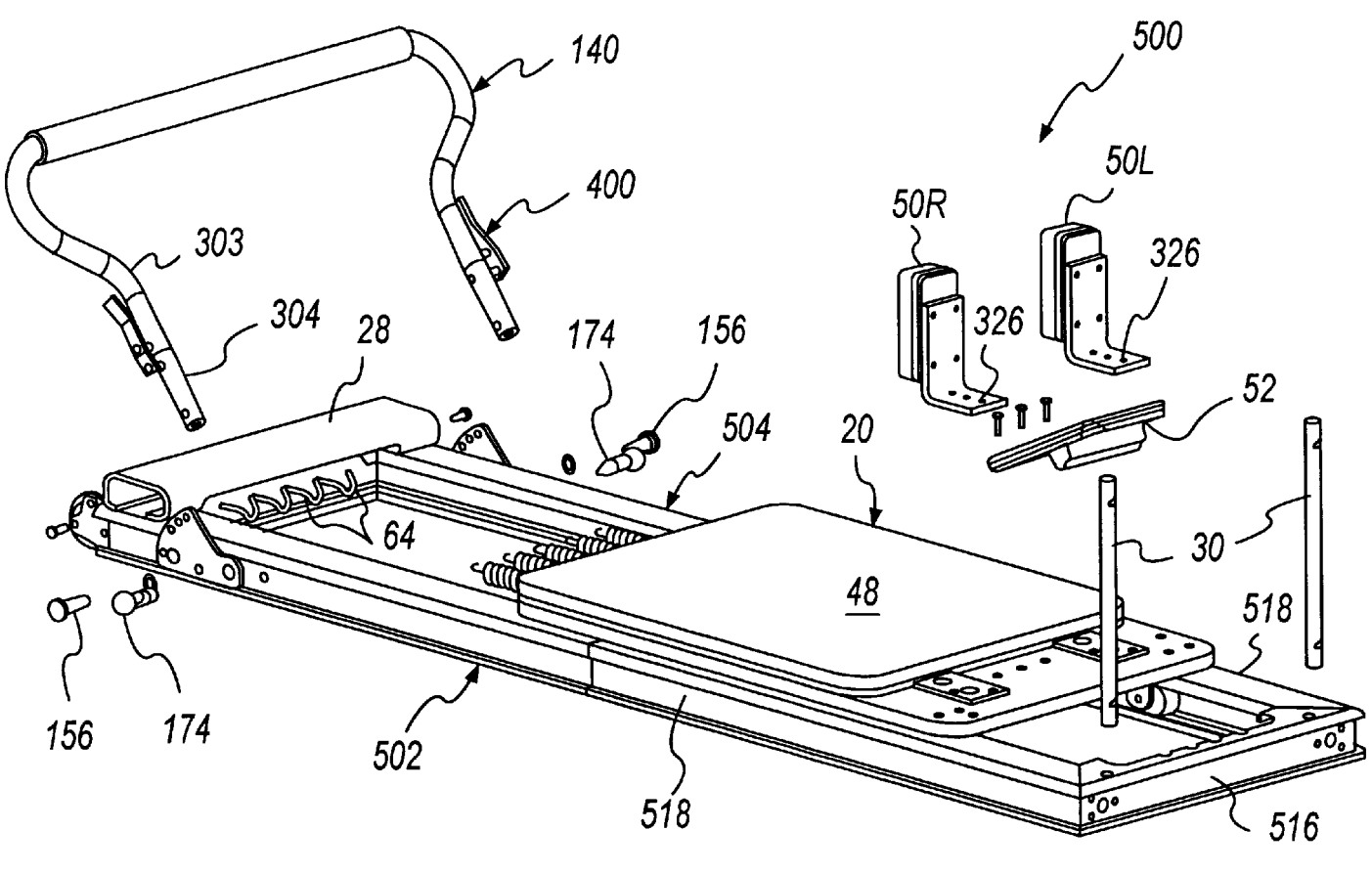
FIG. 17 is a perspective partial exploded view of a fourth embodiment of the exercise apparatus in accordance with the present invention.
Figure 18:
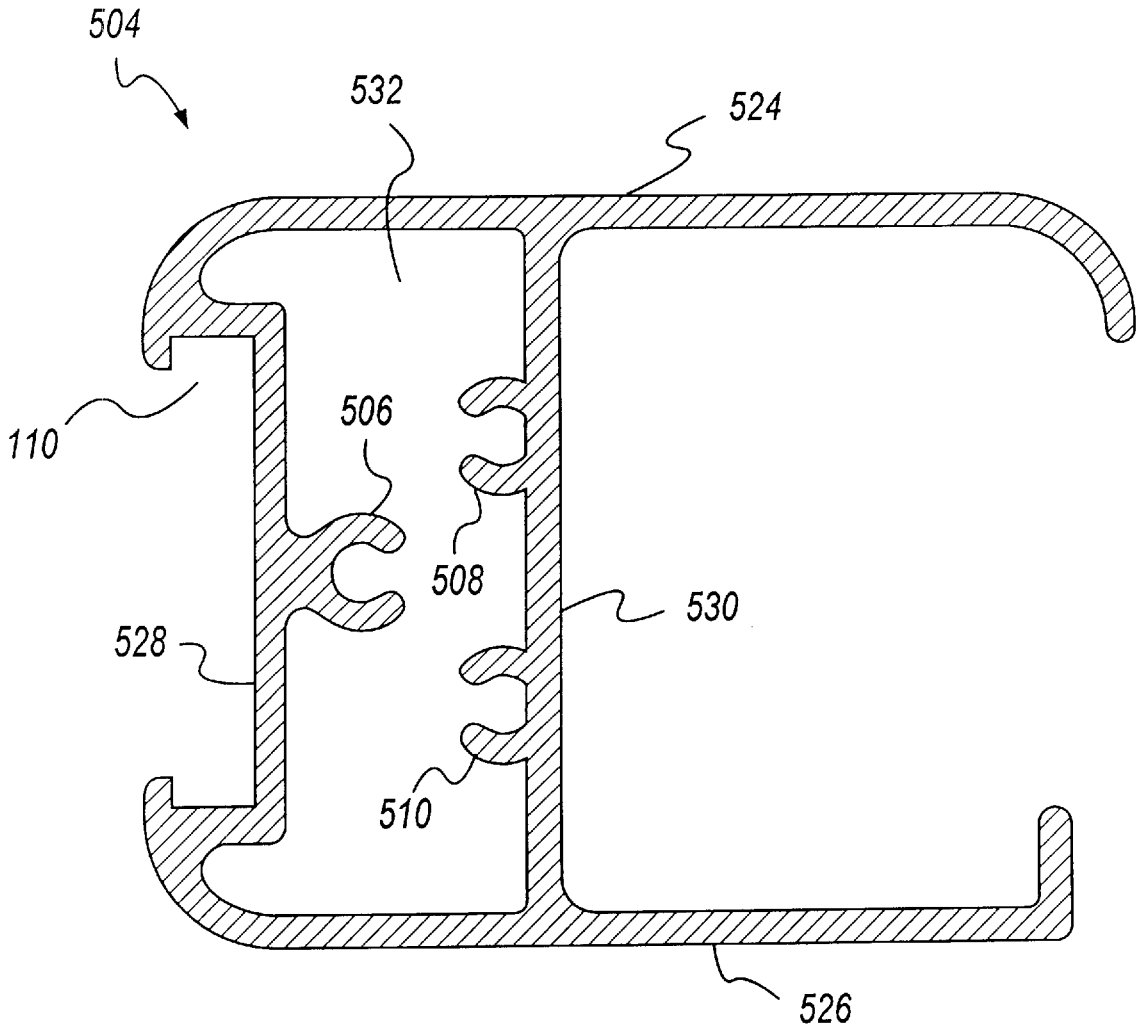
FIG. 18 is a cross sectional view of the side and end rail extrusion utilized in the fourth embodiment of the exercise apparatus in accordance with the present invention.
Figure 19:
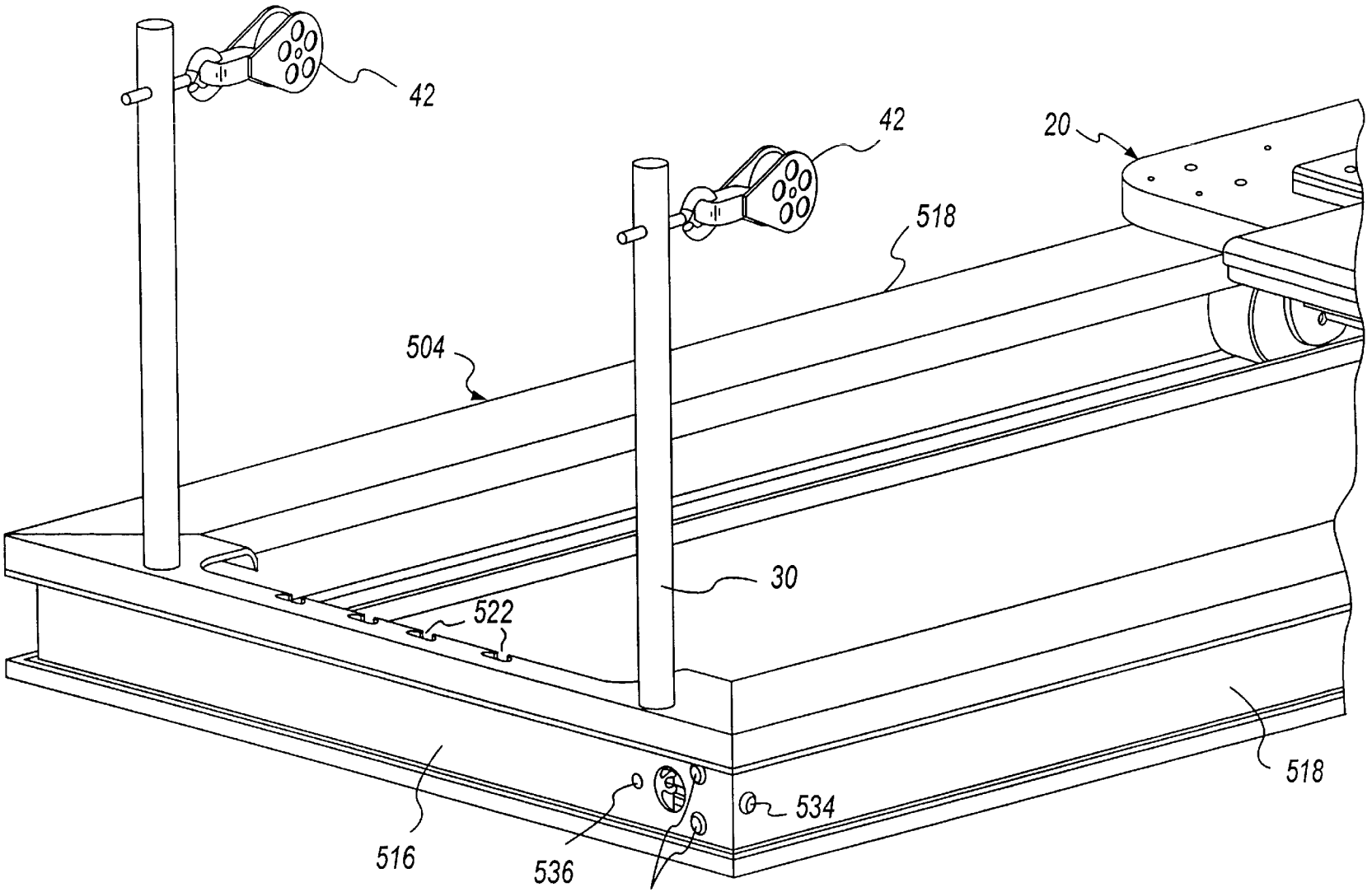
FIG. 19 is a perspective view of the head end portion of the apparatus shown in FIG. 17.

A fourth preferred embodiment 500 of an exercise apparatus in accordance with the invention is shown with particular reference to FIGS. 17 through 22. As in the previous embodiments, like numbers will be used to identify like components in the description that follows. Referring now specifically to FIG. 17, the exercise apparatus 500 is similar to the third embodiment 300 described above and shown in FIGS. 13 through 16 with several differences. First, in this embodiment the shoulder stops 50 are removable as in the third embodiment 300, but are stored directly in blind key way slots cut in the head end of the frame 502. The side rails, head end and foot end of the frame 502 are constructed of the same extrusion 504. The extrusion 504 has three screw races 506, 508, and 510 as shown in FIG. 18, formed in the vertical ribs or walls, permitting the head and foot end corners of the frame 502 to be simply mitered and joined together via three screws as shown in FIG. 19. These screws extend through the outer extrusion wall or rib of one side frame member or end frame member into the screw race of the other member, rather than having to use an L shaped extruded joint member 318. The foot platform 28 is hinged to permit easier access to the spring anchor hooks 64 and spring anchor posts 66. Finally, the arm posts 30 are secured in their sockets via a pin which passes through the vertical walls of the extrusion. Each of these modification will be discussed in more detail below.

Referring now to FIG. 17, the exercise apparatus 500 includes a generally rectangular frame 502 made of a foot end member 514 and a head end member 516 joining opposite ends of a pair of parallel side rail members 518. Each of these members is a length of extrusion 504. A movable carriage 20 slides on rollers as described above with reference to the first three embodiments 100, 200 and 300. A pair of removable shoulder stops 50R and 50L have bayonet pins 330 which interchangeably fit within complementary key slots in the carriage 20 to provide two alternative horizontal spacings of the shoulder stops.

The extrusion 504 is shown in section in FIG. 18. The extrusion 504 has a top wall 524 and a bottom wall 526 spaced apart by a pair of parallel vertical outer and inner ribs or walls 528 and 530. These ribs or walls define an enclosed box channel 532 therebetween. An outer screw race 506 opens inward from the outer wall 528 and extends longitudinally along the outer wall 528 midway between the top wall 524 and the bottom wall 526. The upper and lower inner screw races 508 and 510 divide the inner wall 530 are preferably equally spaced from the top and bottom walls 524 and 526 and extend inward from the inner wall 530 toward the outer wall 528. These screw races 506, 508 and 510 form straight "C" shaped channels extending longitudinally the full length of the extrusion. When the ends of the frame members 518 and 516 are mitered and joined as shown in FIG. 19, they may be joined by a long screw through a hole in the side rail 518 into the screw race 506 of the head end member 516, and two long screws 534 extending through holes in the end member 516 into the upper and lower screw races 508 and 510 of the side member 518. When the screws 534 are tightened, the mitered corner is drawn together to produce a very solid structure.

Each of the arm posts 30 extends vertically down through the box channel 532. A removable pin (not shown) is inserted through each hole 536 and through the post 30 to secure each arm post 30 in place. When the vertical bore receiving the post 30 is formed, by drilling an appropriately sized vertical hole in box channel 532 of the extrusion 504 forming the head end member 516, portions of the screw races 506, 508, and 510 are removed. The result is that the outer surface of the lower end portion of the post 30 contacts the remainder of the three screw races to sandwich the post 30 therebetween and thereby strengthen and rigidify the post 30 mounted in the head end member 516. The arm posts 30 are removed from the vertical bores and inserted through the holes 538 in the head end portion 516 when the apparatus 500 is arranged for storage as shown in FIG. 15.

The inside portion of the top wall 524 is partially cut away to the inner vertical wall 530 between the posts 30. A series of four vertical key way slots 522 are cutout or notched into the vertical wall 530. These slots 522 receive the bayonet pins 330 of the shoulder stops 50 when the stops 50 are stored against the head end 516. These shoulder stops 50 are stored as in FIG. 16 but, in this embodiment, directly against the head end member 516.

Referring back to FIG. 18, the top wall 524, bottom wall 526 and outer vertical rib or wall 528 together form a elongated "T" shaped slot 110 as in the first three embodiments. Similarly, the bottom wall 526, vertical inner wall or rib 530 and top wall 524 form a modified C shaped inner section forming the support/guide channel 114 which opens opposite to the slot 110. The support/guide channel 114 receives the wheel assemblies 22 in the rail members 518 as in the other embodiments 100, 200 and 300 described above.

Figure 20:
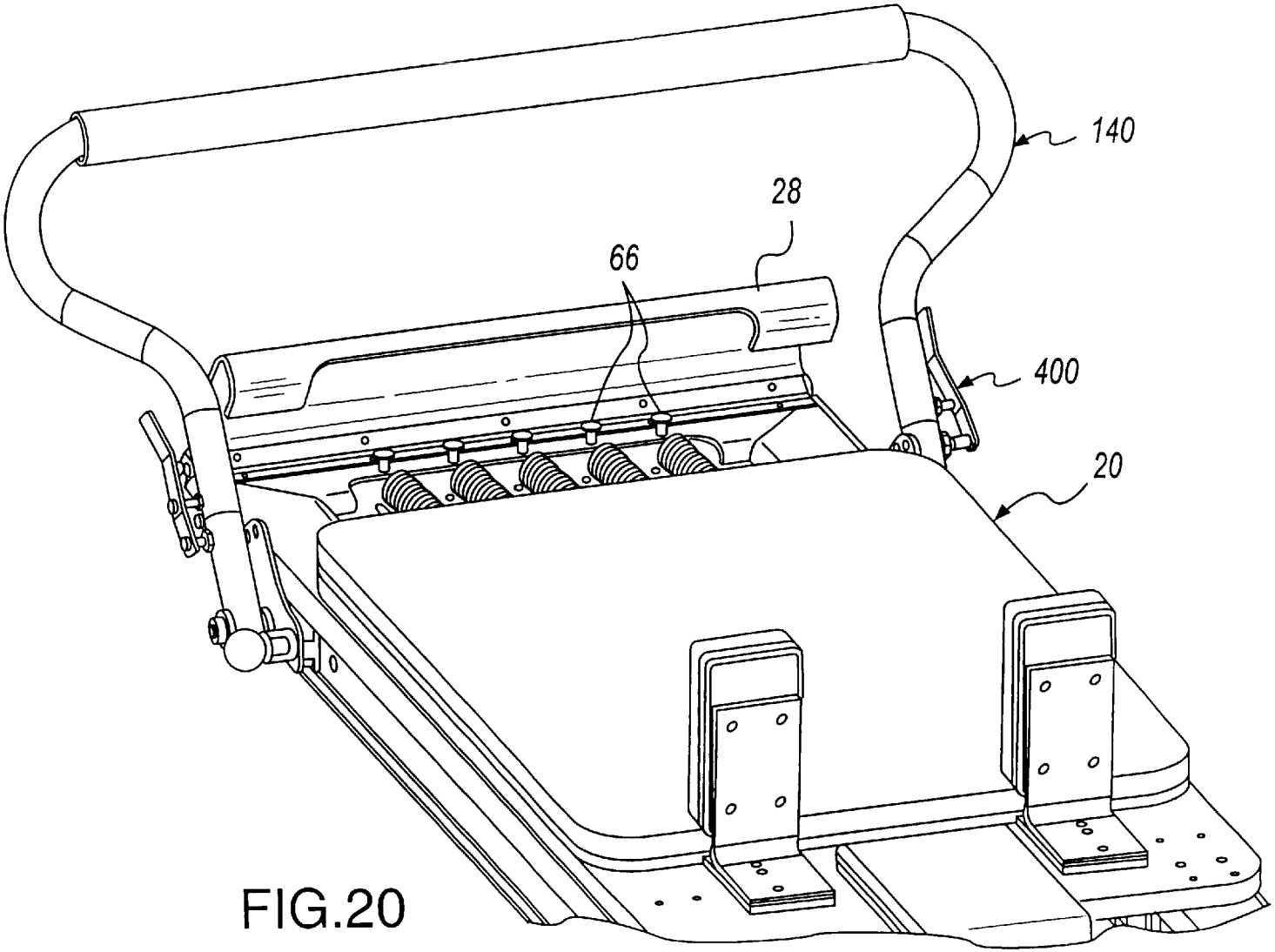
FIG. 20 is a perspective view of the foot end portion of the apparatus shown in FIG. 17 with the standing platform in a raised position.
Figure 21:
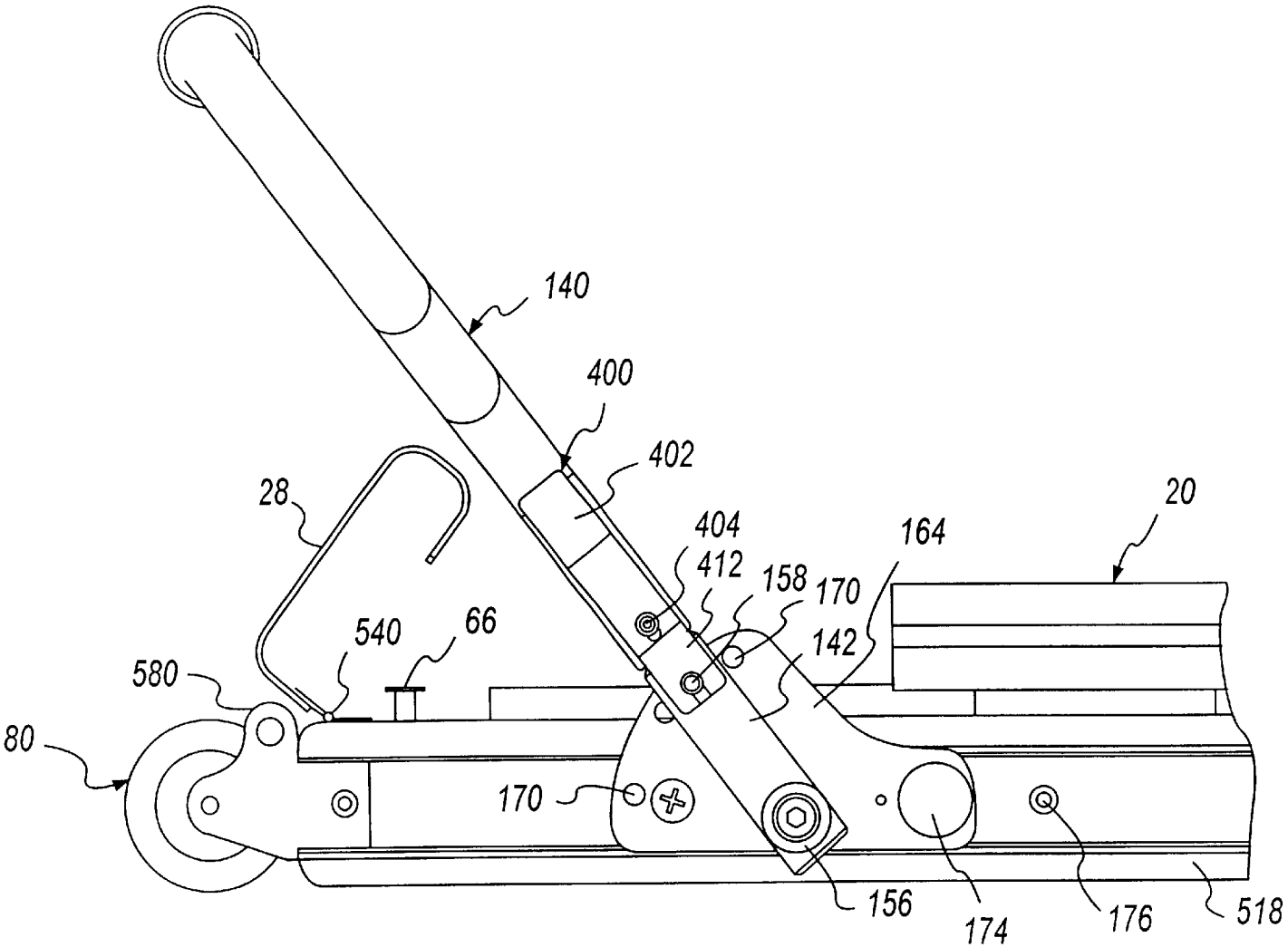
FIG. 21 is a side view of the foot end portion of the apparatus shown in FIG. 17 in accordance with the present invention.
Figure 22:
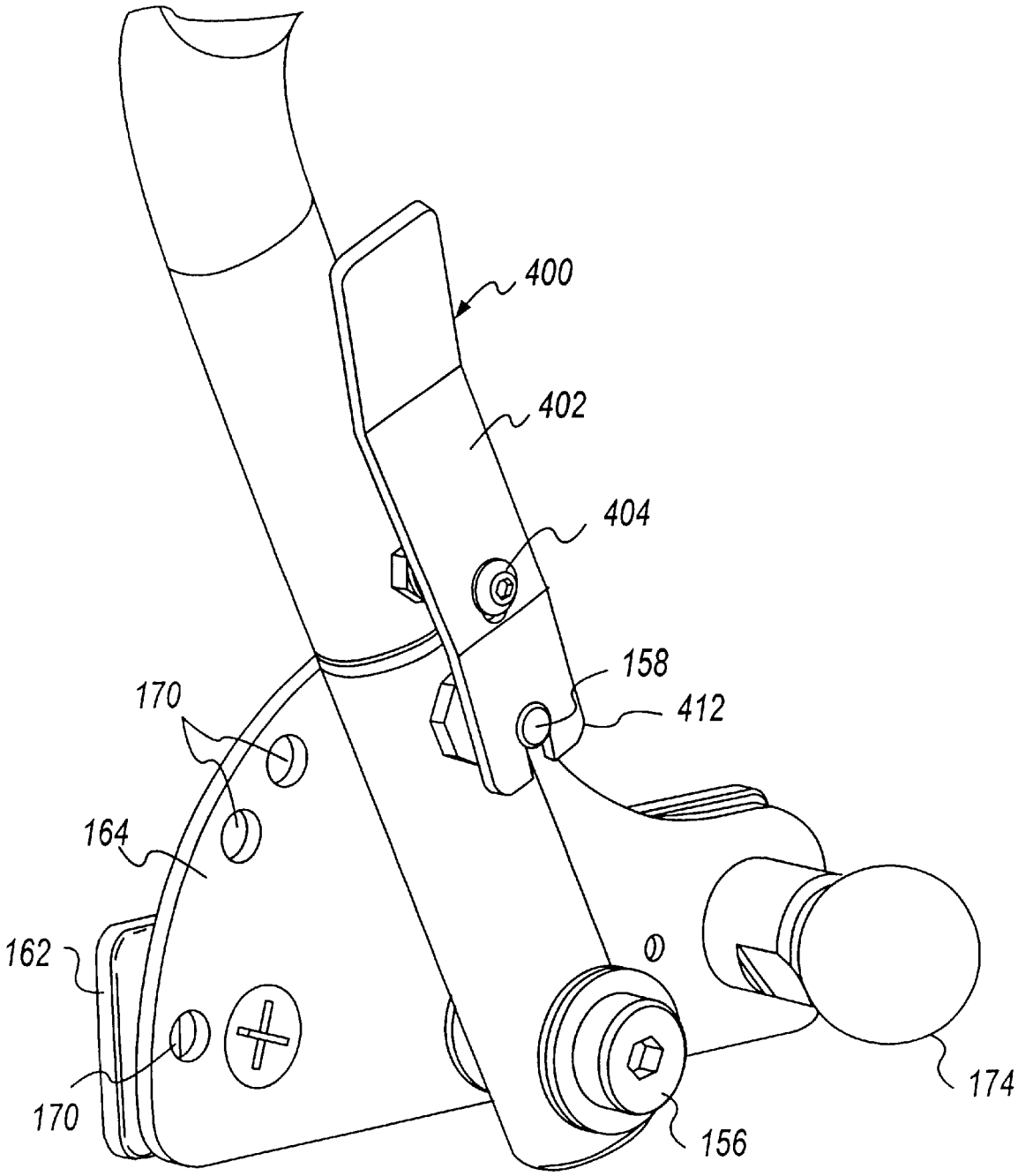
FIG. 22 is a perspective view of a portion of the foot bar assembly shown in FIG. 17 shown separated from the frame.

The foot end portion of the apparatus 500 is shown in perspective view in FIGS. 20 through 22. The foot end portion of the apparatus 500 is similar to that of the third embodiment 300 shown in FIGS. 13 through 15. However, the standing platform 28 is hinged via hinge 540, best seen in the side view of FIG. 21. The hinged platform 28 may be raised in a counterclockwise direction as shown in FIG. 21 until it abuts the foot board support bracket 82 (not shown in FIG. 21). The hinged platform 28 permits easy user access to the alternate spring support pins 66. Further, the support bracket for the wheel assembly 80 includes a hole forming a "fisheye" 580. One end of a foot strap (not shown) may be fastened to the fisheye 580. The other end of the foot strap is fastened through the other fisheye 580 on the opposite wheel assembly 80.

Note that, in FIG. 21, the bottom hole 170 in the bracket 164 is slightly above the horizontal position of the pivot point 156. When the foot bar 140 is positioned with the pin 158 in this hole 170, the foot bar 140 is slightly inclined from horizontal. This configuration is shown in the side view of FIG. 15. this incline permits the units 100, 200, 300 and 500 to be stacked and lets the wheel assemblies 80 to project to permit the user to roll the apparatus to a storage location.

The foot end portion of the apparatus 500 includes a foot bar quick release arrangement 400 shown in the separate enlarged perspective view of FIG. 22. This quick release arrangement 400 in accordance with this aspect of the invention may be used in any one of the apparatuses 500, 300, 200 or 100. Further, the foot bar arrangement 303 or 140 may be incorporated with the quick release arrangement 400. In the description that follows, the foot bar arrangement 140 shown in FIG. 11 will be used as exemplary. The quick release arrangement 400 includes an elongated quick release lever 402 attached to a stationary fulcrum pin 404 projecting from each leg 142 or 144 of the foot bar 140.

The lever 402 is an elongated member having one end 412 attached to the head end of the spring pin 158 which is slidably supported in and removably extends through the leg 142 or 144 of the foot bar 140 into one of the holes 170 in the plate 164. The spring pin 158 is biased, as shown in FIG. 6, by an internal spring within the leg 142, which pushes the spring pin 158 toward the plate 164, and thus into one of the holes 170 if properly aligned. A user, who wishes to change the height of the foot bar 140 simply grasps the legs 402 and 404 while depressing the free ends of the levers 402 against the leg 142 or 144 to pivot the lever 402 about the fulcrum pin 404 to lift the spring pin 158 from the hole 170 in the plate 164. The user then rotates the foot bar 140 to the desired position and releases the levers 402. The user then adjusts the position of the foot bar 140 slightly until the spring pins 158 snap into the nearest holes 170 to the desired position.

The lever 402 may be a generally flat sheet metal bar bent to follow the contour of the leg 142 or 144 or may be a curved elongated, ergonomically shaped plate member having a shape generally complementary to that of the leg 408. The one end 412 of the lever 402 attached to the spring pin 158 preferably has a slot receiving the head of the spring pin 158 and may be secured thereto, for example, with a pin axle having its ends fastened to the lever 402 and passing through a transverse bore through the head of the spring pin 158. Alternatively, the end of the lever 402 may simply hook into a notch in or under the head of the spring pin 158, or otherwise be movably fastened to the head of the spring pin 158.

Figure 23:
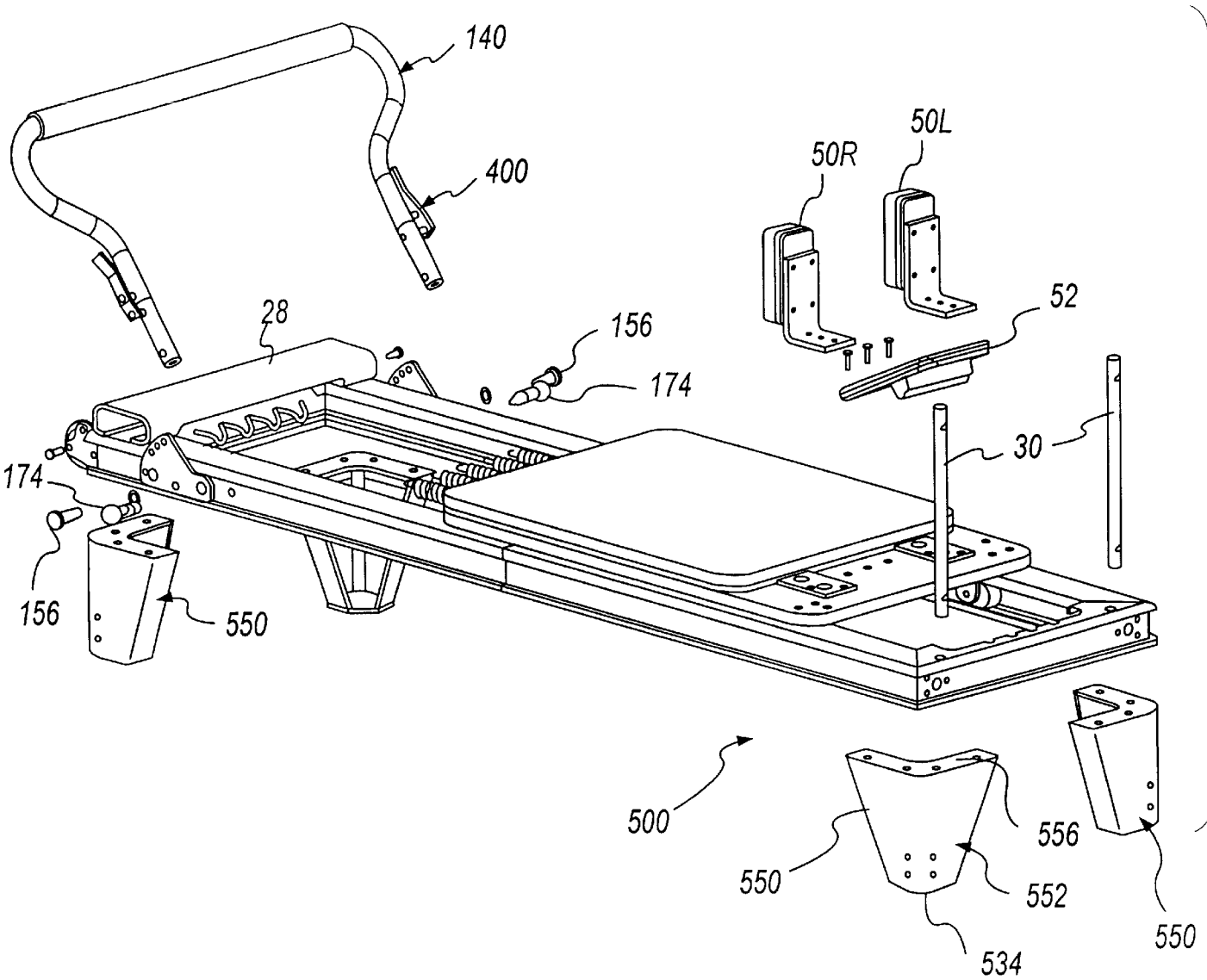
FIG. 23 is a perspective view as in FIG. 17 with optional feet to raise the exercise apparatus above a floor.

Each of the apparatuses 100, 200, 300, and 500 is typically supported directly on a flat surface such as a floor. However, there are situations in which it may be desirable to elevate the apparatus for use, especially in clinical settings. FIG. 23 shows an apparatus 500 as in FIG. 17 with the addition of a set of legs 550. Each leg 550 is an elongated sheet metal body folded to form an upright leg portion 552 having an "L" shaped horizontal cross section and a flat foot end 554 and a flat top flange 556. Alternatively, the leg 550 may be an extruded member having an appropriate shape. The flange 556 is fastened to the underside of the frame 502 preferably with threaded fasteners that permit removal by the user, if desired. The legs 550 are typically about 8–12 inches in length and are fastened to the frame 502 at the corners of the frame 502 so that the mitered corners are fully supported by the flange 556. A cushioning foot pad may be installed on the foot end 554 or a threaded leveling foot (not shown) may be attached to the foot end 554 for use on uneven floors.

Figure 24:
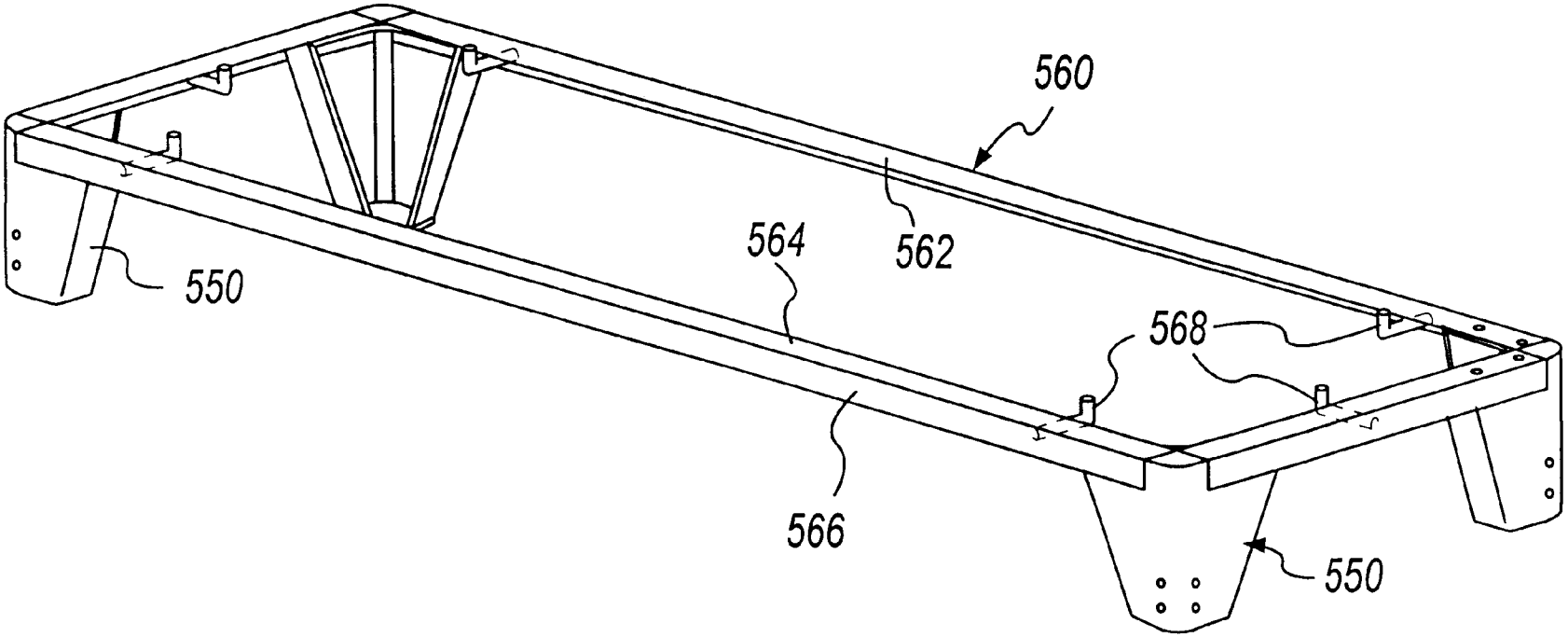
FIG. 24 is a perspective view of a support assembly for supporting the exercise apparatus above a floor.

An alternative support arrangement 560 for the apparatuses 100, 200, 300, and 500 is shown in FIG. 24. The support 560 includes a rectangular frame 562 preferably made of angle aluminum stock which is mitered and welded at the corners. The support 560 has four legs 550 fastened to the corners of the frame 562 preferably as just described above. The frame 562 has a flat top 564 and vertical sides 566. A register pin 568 fastened to the inner edge of the flat top 564 projects upward. The exercise apparatus such as 500 is positioned and aligned over the flat top 564 and then lowered onto the flat top 564 such that each of the pins 568 projects upward adjacent the inner edge of the bottom wall 526, thus keying the frame 502 on the support 560. Alternatively, the pins 568 may be positioned on the top 564 to fit within appropriately positioned holes pre-drilled in the bottom wall 526 of the frame 502. Alternatively, the support 560 may have a number of pins 568 spaced along either the inner or outer edge of the flat top 564 to align the frame 502 with the support frame 562. The legs 550 may be fastened to the support frame 562 by threaded fasteners or they may be permanently welded in place.

Figure 25:
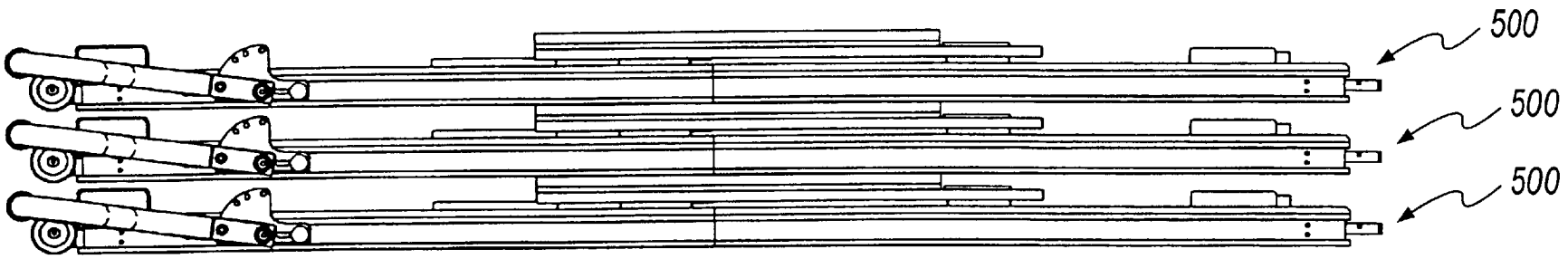
FIG. 25 is a side view of a set of stacked exercise apparatuses in accordance with the present invention.

The exercise apparatus 100, 200, 300 and 500 are designed to be stacked, one on top of the other, as shown in FIG. 25. This collapsed and stacked configuration permits a large number of these apparatuses to be compactly stored in a relatively small space. In addition, the units may be stacked on a cart such as a folding chair cart and wheeled into a closet for storage.

The present invention may be practiced otherwise than as specifically described and shown above. Many changes, alternatives, variations, and equivalents to the various structures shown and described will be apparent to one skilled in the art. For example, the apparatus may be constructed of a metal other than aluminum and could be constructed from a nonmetal material as well. The support rollers 122 and guide rollers 124 may be shaped differently than that shown. The guide rollers 124 may optionally be omitted or replaced by a low-friction glide member. The wheel support bracket 116 may be machined, cast or formed of sheet metal. The arm members 30 may be conveniently stored entirely, when removed from the sockets 36, in clips installed in the support guide channels 114 near the head ends 14 or 316. The latch pin assemblies 38 may be different than those shown, or omitted entirely. The pulley assemblies 42 may be fastened to the arms 30 so as to be adjustable in height above the head end 14. The frame 12 may be positioned substantially above a floor by upright supports 500 fastened to the underside of the bottom wall 98 of the rail members 18. In the third embodiment 300, the foot bar 303 may be replaced with one having a different shape, such as a narrower foot bar or a platform which has appropriately spaced legs, or a flattened foot bar arrangement with ends adapted to fit onto the supports 304.

The shoulder stops 50R and 50L may be alternatively stored by mounting them off of the end of the carriage 20 toward the end 516 of the frame 502. Further, the key ways 334 and pins 330 may be reversed with the pins 330 mounted on the plate 332 and key ways formed in the angle bracket plate 326. In this instance the head end 316 or 516 would have corresponding pins positioned to support the shoulder stops 50 when stored. The legs 550 may have a different shape than shown in the drawing and the guide pins 568 on the support frame for the legs 550 may be replaced by a raised rim on the frame 562, or other such feature to secure the frame 502 of the apparatus 500, 300, 200, or 100 to the support frame 562. In the embodiment 500 shown in FIGS. 23 and 24 the wheels 80 may be removed from the frame 502 and mounted on a bracket (not shown) which is then fastened to the legs 550 via bolts through the holes in the legs.

Figure 26:
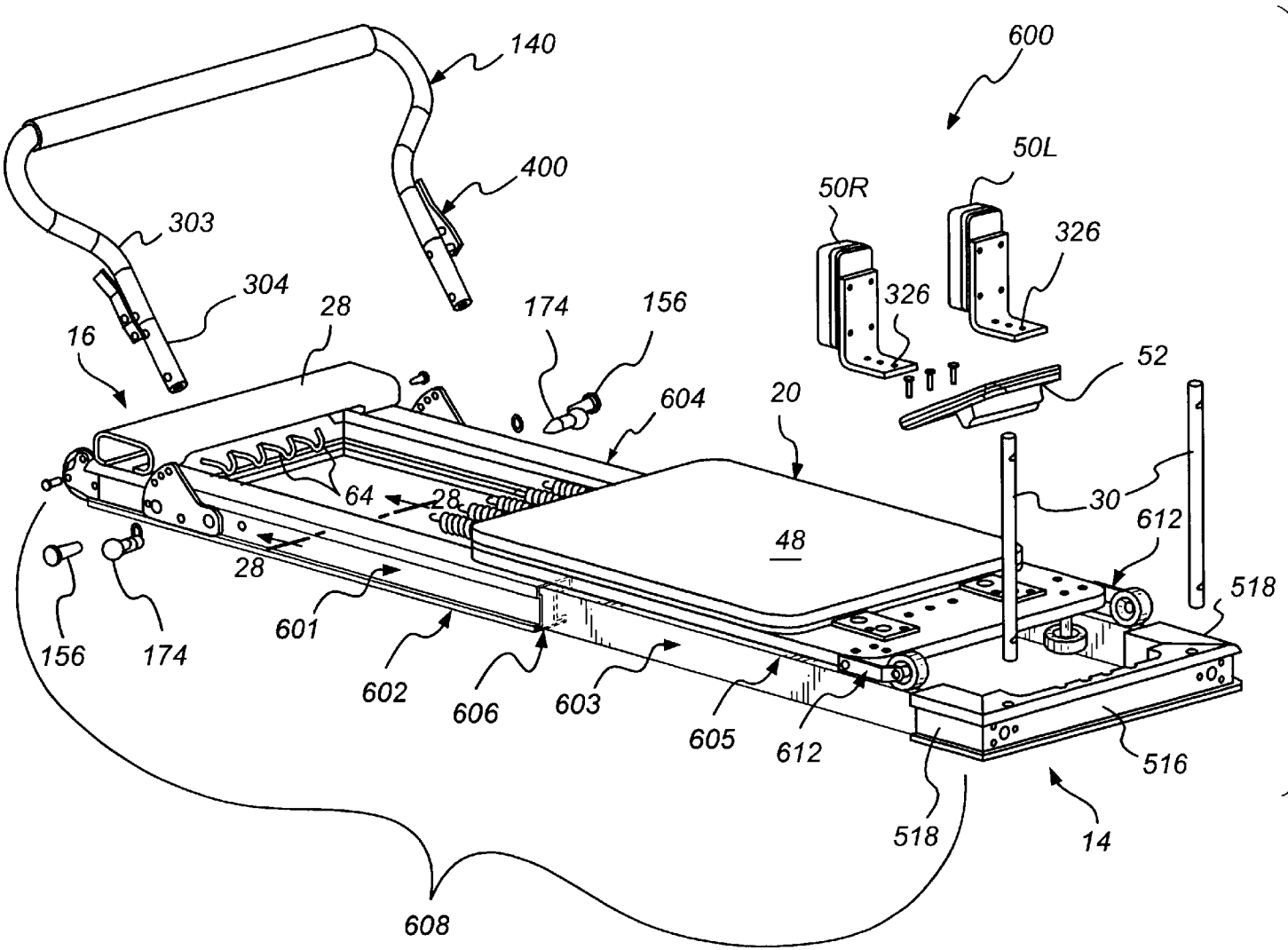
FIG. 26 is a perspective partial exploded view of a fifth embodiment of the exercise apparatus showing the telescopic frame rails in an operating position in accordance with the present invention.
Figure 27:
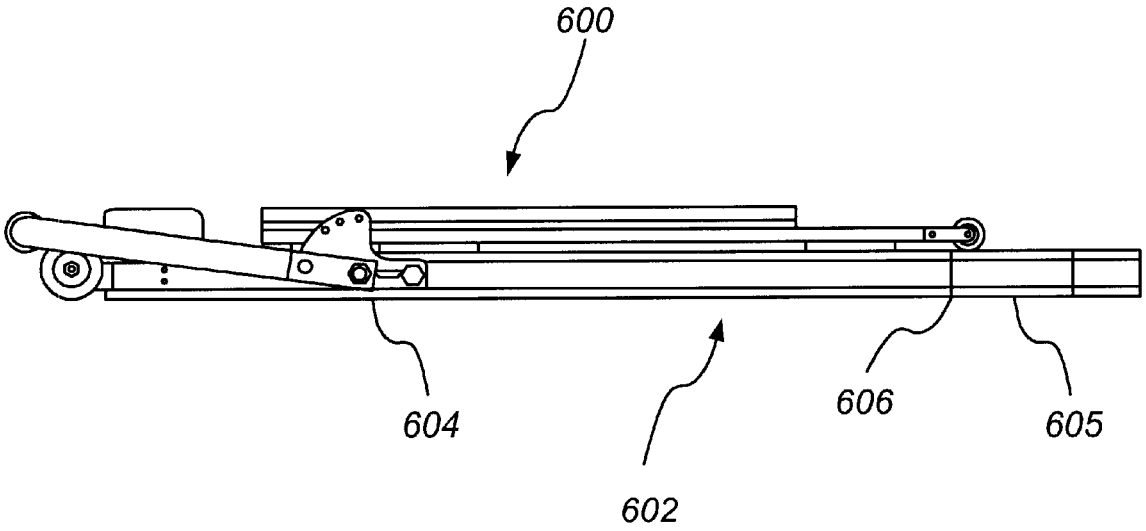
FIG. 27 is a side view of the fifth embodiment of the exercise apparatus showing the apparatus in a storage position in accordance with the present invention.
Figure 28:
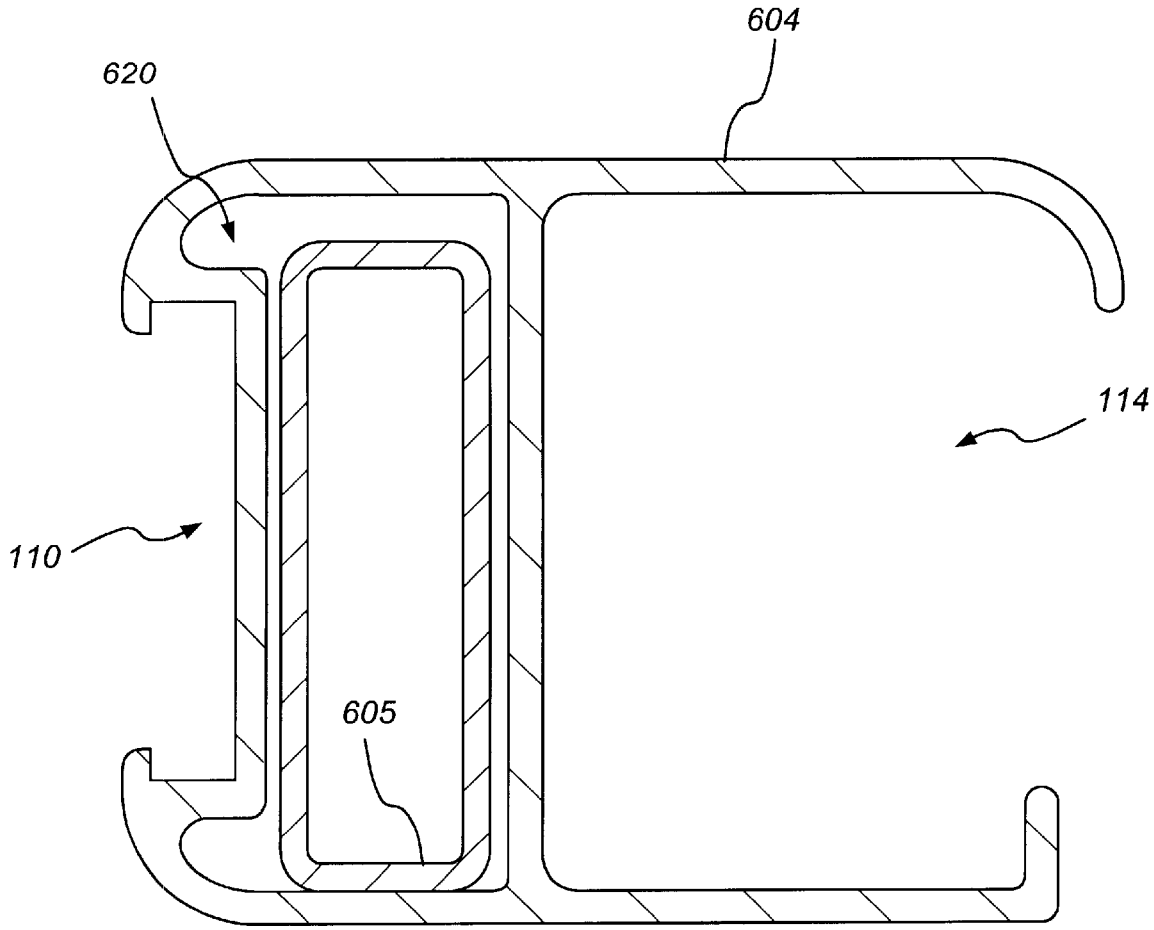
FIG. 28 is a cross sectional view of first and second rail extrusions of the fifth embodiment of the exercise apparatus such that the second rail extrusion is telescopically received inside the first rail extrusion in accordance with the present invention.

A fifth preferred embodiment 600 of an exercise apparatus in accordance with the invention is shown with particular reference to FIGS. 26 through 28. As in the previous embodiments, like numbers will be used to identify like components in the description that follows. Referring now specifically to FIG. 26, the exercise apparatus 600 is similar to the first four embodiments (100, 200, 300 and 500) described above and shown in FIGS. 1–22 with one major difference in the structure of the frame. That is, in the fifth preferred embodiment 600, a rectangular telescopic frame 602 is utilized. The rectangular telescopic frame 602 is made up of two sections 601 and 603 and is capable of substantially reducing the footprint of the exercise apparatus 600 by almost half by telescopically collapsing one section 603 into the other section 601 of the frame 602. Shown in FIG. 27 is a side view of the exercise apparatus 600 in a storage position (i.e., the frame 602 is telescopically collapsed). That is, the telescopic frame 602 is selectively movable between the storage position as shown in FIG. 27 and an extended operating position in which the head frame rail members 605 are fully extended from and retained by the first rail members (see FIG. 26). When the frame 602 is in the storage position, the head frame rails 605 are fully inserted within the foot frame rails 604. The telescopic frame 602 thus provides convenience of storage and portability to a user since, for example, the telescopically collapsed exercise apparatus 600 is more compact and takes less storage area in the user's bedroom or cargo area in a transportation vehicle. In addition, the two sections of the rectangular telescopic frame 602 are separable in a similar way as the second, third, and fourth embodiments (see FIG. 9) for the same storage and portability reasons described hereinabove with respect to those embodiments.

Now referring back to FIG. 26, the rectangular telescopic frame 602 is made up of two frame sections, a foot frame section 601 and a head frame section 603. The foot frame section 601 has two parallel tubular side rails 604 that are constructed of the substantially similar shape and type of metal extrusion used to construct the frame side rails 504 (FIGS. 5, 17, and 18) of the second, third, and fourth embodiments. Two head frame rails 605 are also constructed of tubular extrusion with a generally rectangular cross sectional profile and preferably closed ends. Unlike the foot frame rails 604, the head frame rails 605 do not have the C shaped support/guide channels 114 (FIGS. 5 and 28) and the C shaped outer slots 110 (FIGS. 5 and 28).

The inner cavity of each tubular foot frame rail 604 forms a hollow channel 620 (FIG. 28), and the cross sectional profile of the hollow channel 620 is substantially rectangular. The height and width of the rectangular cross sectional profile of the hollow channel 620 of each foot frame rail 604 is proportionally larger than those of the rectangular cross section of the head frame side rail 605. Each foot frame rail 604 has an open end 606. The ends of the head frame rails 605 are telescopically received inside open ends 606 of the foot frame rails 604. Thus, the head frame rails 605 can be telescoped longitudinally toward the head or foot end 14 or 16 by slidably moving the head frame rails 605 inside the hollow channels 620 of the tubular foot frame rails 604. Further, the telescopically coupled head and foot frame rails 605 and 604 correspondingly extend to form a full frame rail 608 between the head end 14 and the foot end 16. In this embodiment 600, the sections 601 and 603 are preferably pinned in either the storage or operating positions with appropriate through pins 211 (not shown in FIG. 26) passing through both rails 604 and 605 in a conventional manner.

Shown in FIG. 28 is a cross section of one head frame side rail 605 telescopically positioned inside the hollow channel 620 of the tubular foot frame rail 604. As described earlier, the foot frame rail 604 has the C shaped support/guide channels 114 (see also FIG. 5) and the C shaped outer slots 110 (see also FIG. 5), but the head frame rail 605 has none of them. The cross sectional dimensions of the hollow channel 620 are proportional to but somewhat larger than the outer cross sectional dimensions of the head frame rail 605. Although the cross sectional profiles of both the tubular hollow channels 620 and the head frame rails 605 are described as rectangular, it would be clear to those skilled in the art that various other shapes (e.g., circular, oval, eliptical, triangular, etc.) are also suitable for the application. It would also be clear to those skilled in the art that the location of the hollow channel 620 that telescopically receives another rail member is not limited to the foot frame section 601 as disclosed above with respect to the fifth embodiment of the present invention. The hollow channel 620 can be formed inside either the foot frame rail 604 or the head frame rail 605.

Now refer again to FIG. 26 for description of other aspects of the fifth embodiment 600 of the present invention in association with the rectangular telescopic frame 602. The head frame section 603 has a head end member 516 that joins the ends of the two parallel head frame rails 518 and 605. Likewise, the foot frame section 601 has a foot end member 514 that joins the ends of the two parallel foot frame rails 604. The foot frame 601 and head frame 603 sections coupled together form the rectangular telescopic frame 602. The foot frame rail 604 and the head frame rail 605 telescopically coupled together form one of the two frame rails 608 on the rectangular telescopic frame 602. On the two frame rails 608, a movable carriage 20 is rollably mounted and slides on rollers in a substantially similar manner as described above with reference to the first four embodiments 100, 200, 300, and 500. Similarly other elements or parts numbered and shown in FIG. 26 (such as a pair of removable shoulder stops 50R and 50L, arm posts 30, foot platform 28, spring anchor posts 66, foot bar 140, and other components numbered and shown in FIG. 26) operate in an identical or substantially similar manner as described above with reference to the first four embodiments 100, 200, 300 and 500. The primary other difference is embodied in the wheel assemblies 612 supporting the head end of the carriage 20. These wheel assemblies 612 do not ride in the C shaped channel as in the earlier described embodiments. Instead, one wheel of each set rides on the top of one of the rail members 605 and the other wheel of each set rides on an inner side of the same rail member 605.

Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. A collapsible reformer exercise apparatus comprising:

a telescopic rectangular frame having a first frame section and a second frame section, the first frame section including two spaced apart parallel tubular first rail members extending from a first end thereof, each first rail member having an open end opposite the first end, the second frame section including two spaced apart parallel second rail members, each having one end telescopically received in the open end of one of the first rail members of the first frame section, wherein the frame is extendable between a collapsed storage position and an extended operating position;

a movable carriage mounted on the rail members of the frame for supporting a user during movement of the carriage along the rail members between the ends only in the operating position, wherein the carriage is held substantially stationary in the storage position; and an elongated elastic member extending between the first end and the movable carriage for biasing the carriage toward the one end of the frame when the frame is in the operating position.

2. The apparatus of claim 1 wherein the carriage has a set of support rollers, each support roller positioned for rolling along a horizontal surface of one of the rail members and a set of guide rollers each positioned for rolling along a vertical surface of one of the rail members.

3. The apparatus of claim 1 wherein the carriage is held between the ends when the frame is in the first storage position and in the extended operating position the second rail members are fully extended from and retained by the first rail members.

4. The apparatus of claim 1 wherein the second frame section includes a head end support bracket fastened to an opposite end of each of the second rail members.

5. The apparatus of claim 3 wherein second rail members are fully within the first rail members when the frame is in the storage position.

6. The exercise apparatus of claim 1, wherein the first frame section is a foot frame section that includes a foot bracket connecting the two first ends, and wherein the second end is a head frame section that has a head bracket connecting the two second rail members.

7. The exercise apparatus of claim 1, wherein the first and second sections of the rectangular telescopic frame are separable.

8. The exercise apparatus of claim 6, wherein the elastic member extends between the foot bracket and the movable carriage.

9. The exercise apparatus of claim 6, wherein the first rail member is a rectangular tube.

10. The exercise apparatus of claim 4 further comprising an adjustable foot bar assembly adjustably mounted to the first frame section.

11. The exercise apparatus of claim 10, wherein the foot bar assembly comprises a support bracket assembly and a generally U shaped foot bar having a straight foot bar portion and a pair of parallel leg portions extending from the foot bar portion.

12. The apparatus according to claim 1 further comprising:

a generally "U" shaped foot bar pivotally mounted to the rail members near the foot end of the frame, wherein the foot bar has a horizontal foot support portion having opposing end portions each joining an S shaped region merging into one of two parallel support legs, each leg being pivotally fastened to one of the rail members of the frame.

13. A reformer exercise apparatus comprising:

a telescopically collapsible rectangular frame having a first frame section and a second frame section, the first frame section including two spaced apart parallel tubular first rail members extending from a first end thereof, each first rail member having an open end opposite the first end, the second frame section including two spaced apart parallel second rail members, each having one end telescopically received in the open end of one of the first rail members of the first frame section, wherein the frame is extendable between a collapsed storage position and an extended operating position; and a movable carriage mounted on the frame for supporting a user, the carriage having a first set of rollers positioned to roll only along the first frame section and a second set of rollers positioned to roll only along the second frame section to permit the user to move the carriage back and forth between the first end and a second end of the frame when the frame sections are extended in the operating position.

14. The apparatus according to claim 13 wherein the carriage is captured between the ends of the frame when the frame is in the collapsed storage position.

15. The apparatus according to claim 13 further comprising:

a generally "U" shaped foot bar pivotally mounted to the rail members near the foot end of the frame, wherein the foot bar has a horizontal foot support portion having opposing end portions each joining an S shaped region merging into one of two parallel support legs, each leg being pivotally fastened to one of the rail members of the frame.

16. The apparatus according to claim 15 wherein each leg is fastened to the one of the parallel frame members by a bracket that permits the foot bar to be positioned at discrete angles with respect to the frame.

17. The apparatus according to claim 16 wherein the bracket is positioned on each of the rail members so that the foot bar may be rotated beyond the foot end of the frame.

18. The apparatus according to claim 16 wherein the bracket is slidably fastened to the rail member.

* * * * *